US007332256B2

(12) United States Patent
Yoshizawa et al.

(10) Patent No.: US 7,332,256 B2
(45) **Date of Patent: *Feb. 19, 2008**

(54) IMAGE FORMING METHOD AND IMAGE FORMING APPARATUS

(75) Inventors: Hideo Yoshizawa, Hachioji (JP); Hiroshi Yamazaki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 345 days.

This patent is subject to a terminal disclaimer.

(21) Appl. No.: 10/938,318

(22) Filed: Sep. 10, 2004

(65) Prior Publication Data

US 2005/0063722 A1 Mar. 24, 2005

(30) Foreign Application Priority Data

Sep. 18, 2003 (JP) ..... 2003-325881

(51) Int. Cl.
*G03G 15/06* (2006.01)
*G03G 15/08* (2006.01)

(52) U.S. Cl. ..... 430/111.4; 399/53; 399/222

(58) Field of Classification Search ..... 430/124, 430/111.4; 399/53, 222, 262
See application file for complete search history.

(56) References Cited

U.S. PATENT DOCUMENTS

2003/0049054 A1* 3/2003 Ozawa et al. ..... 399/272
2003/0147670 A1* 8/2003 Asano et al. ..... 399/223
2003/0198884 A1* 10/2003 Yamada et al. ..... 430/124

FOREIGN PATENT DOCUMENTS

| | | |
|---|---|---|
| JP | 05-119503 | 5/1993 |
| JP | 06-118681 | 4/1994 |
| JP | 2000-131890 | 5/2000 |
| JP | 2001-209206 | 8/2001 |
| JP | 2001-312082 | 11/2001 |
| JP | 2002-3728321 | 12/2002 |
| JP | 2003-241411 | 8/2003 |

OTHER PUBLICATIONS

An Office Action issued by JPO on Nov. 27, 2007, in connection with Pat. Appl. No. 2003-325881, 4 pgs.
Translation of Office Action issued by JPO on Nov. 27, 2007, 7 pgs.

* cited by examiner

*Primary Examiner*—John L Goodrow
(74) *Attorney, Agent, or Firm*—Squire, Sanders & Dempsey L.L.P.

(57) ABSTRACT

An image forming method includes: forming an electrostatic latent image after charging an organic photoconductor; and developing the electrostatic latent image into a toner image by bringing a developer containing toner and a carrier having a weight average particle size (D4) of 20 to 50 μm into contact with the organic photoconductor comprising a photosensitive layer and a protective layer which is provided when needed, a total thickness of the photosensitive layer and the protective layer being 5 to 15 μm.

7 Claims, 5 Drawing Sheets

TONER WITH NO CORNER

TONER WITH CORNER(S)

TONER WITH CORNER(S)

IMAGE FORMING METHOD AND IMAGE FORMING APPARATUS

BACKGROUND

1. Technical Field

The present invention relates to an image forming method and an image forming apparatus used in the field of copy machines and printers using an electrophotographic process.

2. Description of Related Art

Recently, organic photoconductors have been widely used for electrophotographic photoconductors. The organic photoconductor is more advantageous than other photoconductors in that it is easy to develop materials corresponding to various exposure light source from visible light to infrared light, it is possible to select materials with no environmental pollution and production costs are inexpensive. However, there are drawbacks, e.g., weak mechanical strength and chemical durability, deterioration of electrostatic property of the photoconductor when numerous sheets are printed, occurrence of surface scarring, and the like.

That is, since electric and mechanical external forces are directly added to the surface of the organic photoconductor (hereinafter, also simply referred to as a photoconductor) by a charging unit, a development unit, a transfer unit and a cleaning unit and the like, durability against them is required.

Specifically, the durability is required against the occurrence of abrasion and scarring on the photoconductor surface due to friction, surface deterioration by active oxygen such as ozone, nitrogen oxide and the like produced at corona charging.

In order to solve problems of the mechanical and chemical durability as the above, a construction where a layer structure is a laminated construction of a charge generation layer and a charge transport layer, the charge transport layer of a protection layer is a uniform layer which has high strength and is difficult to permeate active gases, and a thickness of the charge transport layer is more than 20 μm has been frequently employed as the organic photoconductor.

Also, as the other approach, a technology where a protection layer with high strength is placed on the surface of photoconductor or the like has been studied. For example, in JP-Tokukaihei-6-118681A, it has been reported to use a hardened silicone resin as the protection layer of the photoconductor. However, in a method of thickening the film of the charge transport layer and a method of placing the protection layer with high strength as described above, there is problematic in that carriers produced in the charge generation layer diffuse in a crosswise direction before reaching the surface, resulting in problems in sharpness and the like. In the field of digital copy machines, demands for high image quality have been increased and the image formation with high resolution has been studied, but no favorable electrostatic latent image can be obtained by the layer structure and the protection layer where it is easy to result in diffusion of the carriers in this way.

In order to obtain electrophotographic images with high image quality, it is necessary to faithfully reproduce image information as the electrostatic latent image and sharply form potential contrast of exposed/unexposed portions on the organic photoconductor, and therefor, it is important to inhibit the diffusion of carrier until the produced carrier reaches the surface charge. For latent image deterioration of images with high density, it has been reported in The Imaging Society of Japan, Vol. 38, No. 4, pp. 296 that an effect of the diffusion to the electrostatic latent image can not be negligible when D/μ which is a ratio of a diffusion constant (D) in the charge transport layer to drift mobility (μ) becomes large, and that the latent image deterioration becomes large when the thickness of the charge transport layer becomes large.

Also, it has been reported that the photoconductor with thin film thickness is effective for toner scattering prevention of toner images (see JP-Tokukai-2001-209206A), and that the photoconductor with thin layer and large electrostatic capacity can form electrophotographic images with high quality (see JP-Tokukai-2001-312082A). Similarly, the organic photoconductor where the thickness of the charge transport layer is thinned and the diffusion of electrostatic latent image is prevented has been already proposed (see JP-Tokukaihei-5-119503A).

However, when the image formation is performed actually using these proposed organic photoconductors with thin layer for an electrophotographic image forming apparatus, image unevenness due to mechanical attrition unevenness becomes easily impressive as compared to the earlier organic photoconductor with film thickness of 20 μm or more, and it is difficult to maintain image quality over a long time period. This cause is attributed to that the smaller the film thickness of a photosensitive layer is, the larger the reduction of potential retention ability ($\Delta V_1 > \Delta V_2$) is in the case of the same attrition amount as shown in FIG. 1 (figure showing dependency of the potential retention ability reduction on the thickness).

As a result, when the organic photoconductor with thin film is used, the image unevenness due to the attrition unevenness of the organic photoconductor easily occurs.

Also when using the organic photoconductor with thin film and using a developer using toner with small particle size for obtaining the high image quality, toner scatterings in text easily occurs at a portion where the attrition unevenness occurs in the organic photoconductor. This is attributed to the presence of a toner component which easily flies in all directions in concavoconvex areas of the attrition unevenness of the organic photoconductor surface.

SUMMARY

An object of one aspect of the invention is to solve the above issues, provide an electrophotographic image with high image quality over a long time period using an organic photoconductor with thin layer, and further provide a method and an apparatus for image formation using an organic photoconductor with high image quality with less image unevenness and less toner scatterings in text.

In accordance with the first aspect of the present invention, an image forming method comprises: forming an electrostatic latent image after charging an organic photoconductor; and developing the electrostatic latent image into a toner image by bringing a developer containing toner and a carrier having a weight average particle size (D4) of 20 to 50 μm into contact with the organic photoconductor comprising a photosensitive layer and a protective layer which is provided when needed, a total thickness of the photosensitive layer and the protective layer being 5 to 15 μm.

In accordance with the second aspect of the present invention, an image forming apparatus comprises: a rotatable drum where a layer of an organic photoconductor in which a total thickness of a photosensitive layer and a protective layer which is provided when needed is 5 to 15 μm, is formed on a peripheral surface; a charging unit for charging the organic photoconductor; a semiconductor laser light source for exposing the organic photoconductor to an exposure light to form an electrostatic latent image; a development tool for bringing a developer containing toner and a carrier having a weight average particle size (D4) of 20 to 50 μm into contact with the electrostatic latent image to develop the latent image; and a transfer tool for transferring the toner developed on the layer of the organic photoconductor to an image support.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAILED DESCRIPTION OF THE EXEMPLARY EMBODIMENTS

Figure 1:
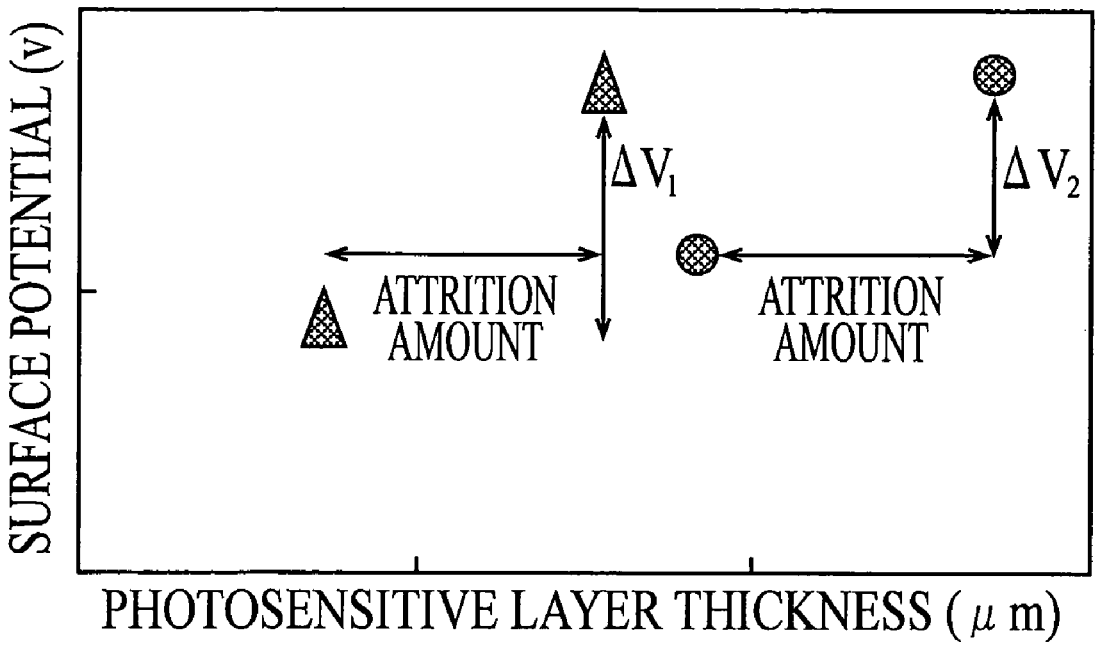
FIG. 1 is a view showing dependency of potential retention capacity reduction on film thickness.

As a result of pursuing a study on the above issues, we have found that to improve sharpness using an organic photoconductor with thinned film thickness and prevent occurrence of image unevenness and toner scatterings in text attributed to attrition unevenness of the organic photoconductor, it is effective to use a developer by which the attrition unevenness is difficult to occur on the organic photoconductor surface and to use a development method by which image unevenness with density difference is not caused in image density even when the attrition unevenness occurs. That is, we have found that the occurrence of image unevenness and toner scatterings in text can be prevented by developing an electrostatic latent image formed on the organic photoconductor with thinned layer using a two-component developer using a carrier with particle sizes in a certain range.

Also, we have found that it is preferable to use toner where a ratio of fine toner is reduced for toner used for the two-component developer as in the above.

The invention will be described in detail below.

a. Total Film Thickness of Photosensitive Layer and Protection Layer

The organic photoconductor used for the image forming method comprises a photosensitive layer and a protection layer provided if necessary, of which total film thickness is from 5 to 15 μm.

The organic photoconductor means an electrophotographic photoconductor configured by allowing an organic compound to have at least one of a charge generation function and a charge transport function which are critical for the construction of the electrophotographic photoconductor, and contains all known organic photoconductors such as photoconductors configured from a known organic charge generation material or a known organic charge transport material and photoconductors where the charge generation function and the charge transport function comprises high molecular complexes.

The photosensitive layer is referred to a layer having at least one function of a function of generating a charge carrier by light exposure and a function of transferring the carrier. The function may be formed by a single layer structure or may comprise a layer structure of two or more layers. It is preferred that the layer structure of the organic photoconductor basically comprises the photosensitive layer of the charge generation layer and the charge transport layer on a conductive support. As the most preferable structure, the photosensitive layer comprises the charge generation layer and the charge transport layer(s) of one or more layers.

The protection layer of the organic photoconductor may have the function of the charge transport layer or need not have the function of charge transport. For example, it may be only a protection layer or may have the function of charge injection layer. Also, the organic photoconductor need not have the protection layer imparted a special function. In that case, the charge transport layer or the like becomes a surface layer.

The total film thickness of the photosensitive layer and the protection layer provided if necessary does not include the thickness of an intermediate layer and a conductive layer or a semiconductor layer provided between the photosensitive layer and a conductive base substance. That is, the total film thickness of the photosensitive layer and the protection layer is an important factor in the formation of electrophotographic image with high image quality (electrostatic latent image with high image quality), and the film thickness of the intermediate layer and the conductive layer or the semiconductor layer is less effective for the high image quality at the exposure than the total film thickness of the photosensitive layer and the protection layer.

The layer structure where the total film thickness of the photosensitive layer and the protection layer installed if necessary of the organic photoconductor is from 5 to 15 μm is preferably the layer structure which makes the charge generation layer and the charge transport layer the multiple-layer structure, of which total film thickness is from 5 to 15 μm. When the total film thickness is less than 5 μm, charging potential easily becomes insufficient. When it is more than 15 μm, the sharpness is not sufficiently improved. Particularly when the total film thickness of the a plurality of charge transport layers is configured in the range of 8 to 14 μm, an improvement effect on the sharpness is more noticeable.

The construction of the organic photoconductor other than the above applied to the invention will be described below.

The layer structure of the organic photoconductor basically comprises the photosensitive layer of the charge generation layer and the charge transport layer on the conductive support. As the most preferable construction, the photosensitive layer comprises the charge generation layer and the a plurality of charge transport layers.

b. Organic Photoconductor

The construction of the specific photoconductor will be described below.

b. 1. Conductive Support

As the conductive support used for the photoconductor, a sheet-shaped or cylindrical conductive support is used.

The cylindrical conductive support means a cylindrical support for forming images with endless by rotating, and is preferably a conductive support in the range of straightness of 0.1 mm or less and run-out of 0.1 mm or less. When the support exceeds this range of straightness and run-out, favorable image formation becomes difficult.

As materials of the conductive support, it is possible to use drums of metals such as aluminium and nickel, or plastic drums where aluminium, tin oxide, indium oxide and the like are deposited, or paper/plastic drums where a conductive substances is applied. The conductive support preferably has a specific resistance of $10^3$ Ωcm or less at ambient temperature.

As the conductive support, one where an alumite film given a sealing treatment is formed on its surface may be used. The alumite treatment is typically performed, for example, in an acid bath such as chromic acid, sulfuric acid, oxalic acid, phosphoric acid, boric acid and sulfamic acid, but an anodic oxidation treatment in sulfuric acid gives the most preferable result. In the case of the anodic oxidation treatment in sulfuric acid, it is preferable to perform under conditions that a concentration of sulfuric acid is from 100 to 200 g/L, a concentration of aluminium ion is from 1 to 10 g/L, a liquid temperature is around 20° C. and an impressed voltage is about 20V, but the conditions are not limited thereto. Also, it is preferred that a mean film thickness of an anodic oxide coating is typically 20 μm or less, and particularly 10 μm or less is preferable.

b. 2. Intermediate Layer

It is preferable to provide the above intermediate layer comprising a barrier function between the conductive support and the photosensitive layer.

In the intermediate layer, it is preferable to contain titanium oxide in the above binder resin with small water absorption. A mean particle size of the titanium oxide particles could be in the range of 10 nm or more and 400 nm or less, and is preferably from 15 nm to 200 nm in number average primary particle size. When it is less than 10 nm, a prevention effect of the intermediate layer on occurrence of moire is small. On the other hand, when it is more than 400 nm, precipitation of the titanium oxide particles of an intermediate layer coating solution easily occurs. As a result, uniform dispersibility of the titanium oxide particles in the intermediate layer is poor, and small black spots easily increase. The intermediate layer coating solution using the titanium oxide particles of which number average primary particle size is in the above range is favorable in dispersion stability, and the intermediate layer formed from such a coating solution is favorable in environmental property and has cracking resistance in addition to a prevention function of small black spot occurrence.

Shapes of the titanium oxide particles used for the invention are dendritic, needle, particulate, and the like. For the titanium oxide particles with such shapes, for example, in the titanium oxide particles, there are an anatase type, a rutile type, an amorphous type, and the like as crystal types, but any of the crystal types may be used, and two or more crystal types may be used in mixture. Among others, one which is the rutile type and particulate is the most favorable.

It is preferred that the titanium oxide particle is given surface treatments. In one of the surface treatments, a plurality of surface treatments are performed, and in the a plurality of surface treatments, as a final surface treatment, the surface treatment using a reactive organic silicon compound is performed. Also, it is preferred that in the a plurality of surface treatments, at least one surface treatment with at least one or more selected from alumina, silica and zirconia is performed and finally the surface treatment using the reactive organic silicon compound is performed.

An alumina treatment, silica treatment or zirconia treatment is referred to the treatment where alumina, silica or zirconia is precipitated on the titanium oxide particle surface, respectively, and alumina, silica and zirconia precipitated on the surface thereof also include hydrates of alumina, silica and zirconia. Also, the surface treatment with the reactive organic silicon compound means that the reactive organic silicon compound is used for a treatment solution.

This way, by performing the surface treatment of the titanium oxide particles at least twice or more, the particle surface of titanium oxide is uniformly surface-coated (treated). When the titanium oxide particles with the surface treatment are used for the intermediate layer, the dispersibility of the titanium oxide particles such as titanium oxide particles in the intermediate layer is favorable, and it is possible to obtain the favorable photoconductor which causes no image defect such as small black spots.

The above reactive organic silicon compound includes the compound represented by the following general formula (1), but is not limited to the following compound so long as it is the compound which performs a condensation reaction with reactive groups such as hydroxy group on the titanium oxide surface.

$$(R)_n—Si—(X)_{4-n}: \qquad \text{General Formula (1)}$$

wherein Si represents a silicon atom, R represents an organic group where carbon is directly bound to the silicon atom, X represents a hydrolytic group and n represents an integer of 0 to 3.

In the organic silicon compound represented by the general formula (1), the organic group represented by R, where the carbon is directly bound to the silicon atom includes alkyl groups such as methyl, ethyl, propyl, butyl, pentyl, hexyl, octyl and dodecyl, aryl groups such as phenyl, tolyl, naphthyl and biphenyl, epoxy-containing groups such as γ-glycidoxypropyl and β-(3,4-epoxycyclohexyl)ethyl, (meth)acryloyl containing groups such as γ-acryloxypropyl and γ-methacryloxypropyl, hydroxy-containing groups such as γ-hydroxypropyl and 2,3-dihydroxypropyloxypropyl, vinyl containing groups such as vinyl and propenyl, mercapto containing groups such as γ-mercaptopropyl, amino-containing groups such as γ-aminopropyl, N-β-(aminoethyl)-γ-aminopropyl, halogen-containing groups such as γ-chloropropyl, 1,1,1-trifluoropropyl, nonafluorohexyl and perfluorooctylethyl, and additionally nitro, and cyano-substituted alkyl groups. Also, the hydrolytic group of X includes alkoxy groups such as methoxy and ethoxy, halogen groups and acyloxy groups.

Also, the organic silicon compound represented by the general formula (1) may be used alone or in combination with one or more.

In the specific compound of the organic silicon compound represented by the general formula (1), when n is 2 or more, a plurality of R's may be the same or different. Similarly, when n is 2 or less, a plurality of X's may be the same or different. Also, when two or more of the organic silicon compounds represented by the general formula (1) are used, R and X may be the same or different between the respective compounds.

The preferable reactive organic silicon compound used for the surface treatment includes polysiloxane compounds. The polysiloxane compound with molecular weight of 1000 to 20000 is easily available in general, and is also favorable in prevention function of small black spot occurrence.

In particular, by using methylhydrogen polysiloxane for the final surface treatment, favorable results are obtained.

b. 3. Photosensitive Layer b. 3. 1. Charge Generation Layer

The charge generation layer contains a charge generation material (CGM). As other materials, a binder resin and other additives may be contained if necessary.

As the charge generation material (CGM), it is possible to use known charge generation materials (CGM). For example, it is possible to use phthalocyanine pigments, azo pigments, perylene pigments, azulenium pigments and the like. In these, CGMs which can minimize residual potential increase associated with repeated use are those having a steric/potential structure capable of taking a stable aggregation structure between a plurality of molecules, and specifically include CGMs of the phthalocyanine pigments and the perylene pigments having certain crystal structures. For example, in the CGMs of titanyl phthalocyanine where Bragg angle 2θ for Cu-Kα ray has a maximum peak at 27.2° and benzimidazole perylene where the 2θ has a maximum peak at 12.4°, there is nearly no deterioration associated with the repeated use and it is possible to reduce the residual potential increase.

When a binder is used as a dispersion medium for the charge generation layer, as the binder it is possible to use known resins, but the most preferable resins include formal resin, butyral resin, silicone resin, silicone modified butyral resin, phenoxy resin and the like. A ratio of the binder resin to the charge generation material is preferably from 20 to 600 parts by mass per 100 parts by mass of the binder resin. By the use of these resins, it is possible to minimize the residual potential increase associated with the repeated use. A film thickness of the charge generation layer is preferably from 0.01 μm to 2 μm.

b. 3. 2. Charge Transport Layer

The charge transport layer contains a charge transport material (CTM) and a binder resin which disperses the CTM and makes a film. As other materials, additives such as anti-oxidant may be contained if necessary.

It is preferred to use a known hole-transporting (P type) charge transport material (CTM) as the charge transport material (CTM). For example, it is possible to use triphenylamine derivatives, hydrazone compounds, styryl compounds, benzidine compounds, butadiene compounds and the like. For these charge transport materials, layer formation is typically performed by dissolving in an appropriate binder resin. In these, CTMs which can minimize the residual potential increase associated with the repeated use are those having properties that the mobility is high and a difference of an ionization potential from that of the combined CGM is 0.5 (eV) or less, preferably 0.30 (eV) or less.

The ionization potential of CGM and CTM is measured by a surface analysis apparatus $1.5\times10^{-9}$ C−1 (supplied from Riken Keiki Co., Ltd.).

The binder resins used for the charge transport layer (CTL) may be any of thermoplastic or thermoset resins. For example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins and copolymer resins containing two or more of repeated unit structures of these resins, and high molecular organic semiconductors such as poly-N-vinyl carbazole in addition to these insulative resins are included. In these, polycarbonate resins where water absorption is small, dispersibility and electrophotographic property of the CTM are favorable are the most preferable.

It is preferred that a ratio of the binder resin to the charge transport material is from 50 to 200 parts by mass per 100 parts by mass of the binder resin.

b. 4. Protection Layer

As the organic photoconductor, it is preferable to provide a protection layer having a function of charge transport and containing fluorine type resin particles which reduce surface energy. The fluorine type resin particle contained in the protection layer means a resin particle which contains fluorine atoms. For example, it is preferable to select one or two or more from a tetrafluoroethylene resin, a trifluorochloroethylene resin, a hexafluoroethylenepropylene resin, a vinyl fluoride resin, a fluorovinylidene resin, a difluorodichloroethylene resin and copolymers of them, and particularly tetrafluoroethylene and fluorovinylidene resins are preferable. A molecular weight and particle sizes of the fluorine type resin particles can be appropriately selected and are not particularly limited.

A construction where the fluorine type resin particles are contained in the binder resin is preferable in the protection layer. A percentage of the fluorine type resin particles is affected depending on the particle sizes of particles, but is preferably from 1 to 50%, and more preferably from 5 to 40% by mass based on a whole mass of the protection layer. Furthermore, it is preferred that the charge transport material is contained in the protection layer.

Additives such as a coupling agent and anti-oxidant may be added to the protection layer for the purpose of improving dispersibility, binding capacity and weather resistance.

Dispersion methods of the fluorine type resin particles of the protection layer include methods using a homogenizer, ball mill, sand mill, roll mill and ultrasound. They are not particularly limited so long as they can disperse particles with primary particle size.

As a dispersion aid of the fluorine type resin particles, various surfactants, for example, comb-like graft polymers may be appropriately mixed.

It is preferred that a film thickness of the protection layer is from 0.1 to 4 μm. When it is less than 0.1 μm, surface hardness and strength are insufficient, and durability is easily reduced. When it is more than 4 μm, contrast potential formed by the latent image at development is easily deteriorated. More preferably it is from 0.2 to 3.0 μm.

The protection layer has preferably low surface energy in order to satisfy cleaning property and stain resistance. As the low surface energy property measured by a contact angle with water, 90° or more is preferable. When it is less than 90°, charging products and dropout matters brought from toner and paper due to the repeated use by electrophotographic process easily adhere to the surface, and deterioration of the latent image (image deletion) due to bad cleaning and reduction of surface resistance easily occurs. More preferably, it is 95° or more.

By employing the above construction, it is possible to provide the organic photoconductor where sharpness can be noticeably improved, and image defects such as image unevenness and toner scatterings in text which easily occur when the film thickness of the charge transport layer is thinned are prevented, and potential performance is stable.

Solvents or dispersion media used for the layer formation of the intermediate layer, the charge generation layer, the charge transport layer and the like include n-butylamine, diethylamine, ethylenediamine, isopropanolamine, triethanolamine, triethylenediamine, N,N-dimethylformamide, acetone, methylethylketone, methylisopropylketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl Cellosolve, and the like. The invention is not limited thereto, and dichloromethane, 1,2-dichloroethane, methylethylketone and the like are preferably used. These solvents can be also used alone or as a mixed solvent of two or more.

Next, as coating processing methods for producing the organic photoconductor, the coating processing methods such as dip coating, spray coating and circle amount regulation type coating are used. It is preferred that the coating processing method such as spray coating and circle amount regulation type coating (circle slide hopper type is its representative) is used for coating processing at an upper layer side of the photosensitive layer not to dissolve the film at a lower layer as possible and to accomplish uniform coating processing. It is the most preferable to use the above circle amount regulation type coating for the protection layer. The above circle amount regulation type coating is described in detail, for example, in JP-Tokukaisho-58-189061A.

c. Developer

Next, a developer will be described. The developer is a two-component developer containing toner and a carrier.

c. 1. Construction of Carrier

A weight average particle size (D4) of the carrier is from 20 to 50 μm. By the use of the carrier in this range, it is possible to prevent the following (S) of the developer for the photoconductor from exceeding, consequently prevent attrition unevenness of the photoconductor, and prevent the occurrence of image unevenness and toner scatterings in text. On the other hand, when the weight average particle size (D4) of the carrier is more than 50 μm, the following (S) easily becomes excessive, and consequently the image unevenness and toner scatterings in text easily occur. When the weight average particle size (D4) is less than 20 μm, adherence of the carrier to the photoconductor easily occurs and consequently spotted image defects easily occur.

It is preferred that the following (S) is from $1.5\times10^{-9}$ to $3.0\times10^{-8}$ $kgm^2/sec^2$. By developing the electrostatic latent image on the organic photoconductor in the range of $1.5\times10^{-9}$ to $3.0\times10^{-8}$ $kgm^2/sec^2$ of the following (S), it is possible to reduce the attrition unevenness which occurs on the organic photoconductor and make the electrostatic latent image a favorable toner image with no occurrence of the image unevenness and the toner scatterings in text. In the following function of (S), in the case where a line speed of a development sleeve is equal to or more than a line speed of the organic photoconductor, it is possible to obtain more favorable electrophotographic images.

$$S\ (kgm^2/sec^2)=\text{average mass of one carrier particle}\times(\text{Line speed of development sleeve}-\text{Line speed of organic photoconductor})^2$$

In the above formula, the average mass of one carrier particle is defined by the following formula.

$$\text{Average mass of one carrier particle}=4/3\pi\ (\text{Average particle size of carriers}/2)^3\times\text{Specific gravity of carrier}$$

As the carrier, the carrier which can reduce the above (S) is preferable. In particular, dispersion type carriers where magnetic particles of 0.1 to 1.0 μm are dispersed in the binder resin are preferable. As the magnetic particles, it is possible to use known materials, such as metals, such as iron, ferrite, magnetite and hematite, and alloys.

As the binder resin in which the magnetic particles are dispersed, thermoset resins are preferable. As the thermoset resins, there are phenol type, epoxy, polyamide, melamine, urea, unsaturated polyester, alkyd, xylene, acetoguanamine, furan, silicone type, polyimide, and urethane resins. These resins may be used alone or in mixture of two or more, but it is preferable to contain at least phenol resin.

As methods for producing these dispersion type carriers, it is possible to use the known methods for production.

For the carrier, the weight average particle size (D4) thereof is from 20 to 50 μm. The weight average particle size (D4) can be measured representatively by a laser diffraction type particle size distribution measuring apparatus equipped with a wet dispersing machine, "Helos" (supplied from Sympatec).

It is preferred that volume resistance of the carrier is from $10^8$ to $10^{12}$ Ωcm.

When the volume resistance of the carrier is in the above range, it is possible to obtain toner images where reproduction of thin lines such as texts is favorable and image density is high.

In a method for measuring the resistance of carrier, the carrier left under an environment at 25° C./50% RH for 12 hours is used, the carrier is filled between parallel electrodes, and a height (H cm) thereof is measured. Then, a direct-current voltage of 1000 V is impressed between them in a state where a constant load (39.2 KPa) is imparted, a current value (I A) after 30 sec is measured, and the resistance is calculated from the following calculation formula. A measurement environment is 25° C. and 50% RH.

$$\text{Resistance}\ (\Omega\cdot cm)=1000/(I\times H)$$

c. 2. Construction of Toner

Next, toner used for the formation of toner image will be described.

In the toner used for the formation of the toner image:

1) a percentage of toner particles where a shape coefficient of the toner particle is in the range of 1.2 to 1.6 is 65% or more by number; and
2) when particle size of the toner particle is D (μm), a natural logarithm lnD is made an abscissa axis and a histogram is made which represents particle size distribution by number classified into a plurality of classes on this abscissa with 0.23 intervals, then a sum (M) of a relative frequency ($m_1$) of toner particles included in the most frequent class in the histogram and a relative frequency ($m_2$) of toner particles included in the second most frequent class is 70% or more.

That is, by the use of the developer containing the toner which fulfills at least one or more conditions of the above 1) and 2) for the above organic photoconductor, it is possible to prevent the image unevenness and the toner scatterings in text and obtain the favorable electrophotographic image. It is more preferable to satisfy both conditions of the above 1) and 2).

Furthermore, it is the most preferable to use the toner which fulfills a condition of the following 3) in addition to the conditions of the above 1) and 2).

3) A percentage of toner particles with no corner is 50% or more by number.

That is, by combining the toner which fulfills all conditions of the above 1) to 3), the developer using the carrier having the volume resistance of the invention and the above organic photoconductor with thin layer, i.e., the organic photoconductor where the sum film thickness of the photosensitive layer and the protection layer provided if necessary (hereinafter, also referred to as organic photoconductor with thin layer) is 5 to 15 μm, it is possible to noticeably improve the image unevenness and the toner scatterings in text.

The toners of the above 1) to 3) will be described below.

c. 2. 1. Shape Coefficient of Toner (That is, Shape Coefficient of Toner Particle)

The shape coefficient of toner particles is represented by the following formula and indicates a degree of roundness of the toner particle.

$$\text{Shape coefficient}=((\text{maximum diameter}/2)^2\times\pi)/\text{projected area}$$

Here, the maximum diameter is referred to a width of particle where an interval of parallel lines becomes maximum when a projected image of the toner particle onto a flat surface is sandwiched with two parallel lines. Also, the projected area is referred to an area of the projected image of the toner particle onto the flat surface.

This shape coefficient was measured by taking a photograph where the toner particle is magnified at 2000 times by a scanning electron microscope and then analyzing a photographic image based on this photograph using "Scanning image analyzer" (supplied from JEOL Ltd.). At that time, using 100 toner particles, the shape coefficient is measured by the above calculation formula.

In the toner, a percentage of the toner particles where this shape coefficient is in the range of 1.2 to 1.6 is 65% or more, and preferably 70% or more by number.

By developing the latent image formed on the above organic photoconductor with thin layer by the developer containing 65% or more by number of the toner particles where this shape coefficient is in the range of 1.2 to 1.6, the image unevenness and the toner scatterings in text are prevented and the favorable electrophotographic image with sharpness is obtained.

Methods for controlling this shape coefficient are not particularly limited. For example, there are methods where the toner particles which make the shape coefficient 1.2 to 1.6 are prepared by a method of spraying the toner particles in heated air flow, a method of repeatedly imparting mechanical energy by impact force to the toner in a gas phase, a method of adding the toner to a solvent which does not dissolve and imparting spiral flow, and the like, and this is added into the common toner to become within the range of the invention to prepare. Also, there is a method where the toner particles where the shape coefficient is regulated to 1.2 to 1.6 by controlling whole shapes at the stage where polymerization process toner is prepared are similarly added into the common toner to prepare.

In the above methods, the polymerization process toner is preferable in terms of simplicity as the production method and being more excellent in uniformity of the surface compared to pulverized toner. The polymerization process toner (also referred to as polymerization toner) means the toner formed by the generation of binder resin for the toner, polymerization of a raw material monomer where a toner shape is the binder resin, and if necessary, subsequent chemical treatments. More specifically, it means the toner obtained through the polymerization reaction such as suspension polymerization and emulsification polymerization and if necessary, a fusion process of particles one another subsequently performed.

Since the polymerization toner is produced by uniformly dispersing the raw material monomer in an aqueous system and subsequently polymerizing, the toner where the particle size distribution and the shapes of the toner are uniform is obtained.

In order to control the shape coefficient of this toner extremely uniformly without variation of lots, a proper step termination time period may be determined with monitoring properties of the toner particles (colored particles) which are being formed in steps of preparing (polymerizing) resin particles (polymer particles) which compose the toner, fusing the resin particles, and controlling the shapes.

Monitoring means controlling step conditions based on measurement results by incorporating a measurement apparatus in line. That is, for example, in the polymerization toner formed by associating or fusing the resin particles in an aqueous medium, by incorporating the measurement of shapes and the like in line, in the step such as fusion, as sampling is sequentially performed, the shape or the particle size is measured. At the time point when it becomes the desired shape, the reaction is stopped.

Monitoring methods are not particularly limited, and it is possible to use a flow type particle pattern analysis apparatus FPIA-2000 (supplied from To a Medical Electronics Co., Ltd.). This apparatus is suitable because the shape can be monitored by performing image processing in real time with passing a sample liquid. That is, using a pump and the like, the shape is always monitored from a reaction field and measured. At the time point when it becomes the desired shape, the reaction is stopped.

c. 2. 2. Percentage of Toner Particles with No Corner

In the toner particles which compose the toner, the percentage of toner particles with no corner is preferably 50% or more by number, and more preferably this percentage is 70% or more by number.

By developing the latent image formed on the above organic photoconductor with thin layer by the developer using the toner where the percentage of toner particles with no corner is 50% or more by number, the image unevenness and the toner scatterings in text are prevented and the favorable electrophotographic image with sharpness is obtained.

Figure 2A:
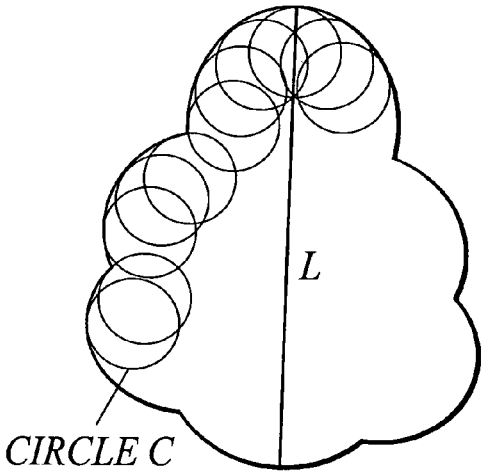
FIG. 2A is an explanatory view showing a projected image of a toner particle with no corner.
Figure 2B:
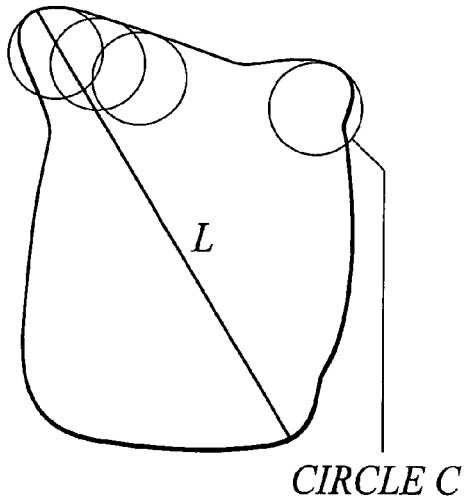
FIG. 2B and FIG. 2C are explanatory views showing a projected image of a toner particle with corners, respectively.
Figure 2C:
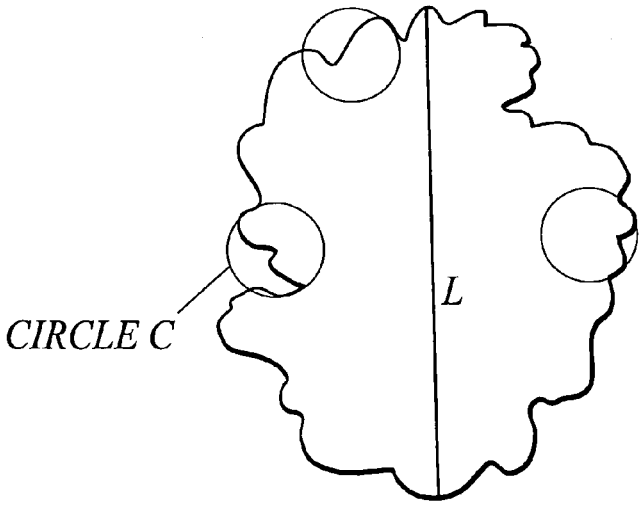

Here, the "toner particle with no corner" is referred to the toner particle which substantially has no salient to which charge is concentrated or no salient which is easily worn away by stress, and the following toner particle is specifically referred to the toner particle with no corner. That is, as shown in FIG. 2A, when a major axis of the toner particle T is made L and a circle C with radius of (L/10) is rolled inward with contacting inward at one point for a surrounding line of the toner particle T the case where the circle C is not substantially protruded outside the toner particle T is referred to the "toner particle with no corner". The "case of not substantially protruding" is referred to the case where the salient where the protruded circle is present is one or less. Also, the "major axis of the toner particle" is referred to the particle width where the distance between parallel lines becomes maximum when a projected image of the toner particle onto the flat surface is sandwiched with the two parallel line. FIGS. 2B and 2C show projected images of the toner particles with corners, respectively.

The measurement of the percentage of toner particles with no corner was performed as follows. First, a photograph which magnifies the toner particle is taken by a scanning electron microscope, and a photographic image at 15,000 times is obtained by further magnifying. Then, the presence or absence of the above corner is measured for this photographic image. This measurement was performed for 100 toner particles.

Methods for obtaining the toner with no corner are not particularly limited. For example, it is possible to obtained by the method of spraying the toner particles in heated air flow, the method of repeatedly imparting mechanical energy by impact force to the toner in a gas phase, and the method of adding the toner to a solvent which does not dissolve and imparting spiral flow as mentioned above as the methods for controlling the shape coefficient.

In the polymerization process toner formed by associating or fusing the resin particles, at a fusion stop stage, there are many irregularities on the surface of the fused particles and the surface is not smooth, but the toner with no corner is obtained by making the conditions such as temperature, rotation frequency of stirring wings and stirring time period appropriate. These conditions vary depending on physical properties of the resin particles. For example, the surface becomes smooth and the toner with no corner can be formed by making the rotation frequency higher at temperature not less than glass transition temperature of the resin particles.

c. 2. 3. Particle Sizes of Toner Particles

A number particle size distribution of the toner particles is measured by Coulter Counter TA— or Coulter Multisizer (supplied from Coulter). In the invention Coulter Multisizer was used by connecting an interface (supplied from Nikkaki) which output the particle size distribution, a personal computer. As an aperture used in the above Coulter Multisizer, an aperture with 100 μm was used to measure the volumes and the number of toner particles which were 2 μm or more, and the particle size distribution and the average particle size were calculated. The number particle size distribution represents a relative frequency of the toner particles for the particle sizes, and a number average particle size represents a median diameter in the number particle size distribution.

As the particle size of the toner, those where the number average particle size is from 3.0 to 8.5 μm are preferable. This particle size can be controlled in the case of forming the toner particles by the polymerization method by a concentration of a coagulant, an addition amount of an organic solvent or a fusion time period, and additionally a composition of the polymer itself in the method for producing the toner mentioned below.

By making the number average particle size 3.0 to 8.5 μm, transfer efficiency becomes high to improve image quality of half torn and improve image quality of thin lines, dots and the like.

The toner is the toner where when particle size of the toner particle is D (μm), the natural logarithm lnD is made the abscissa axis and the histogram is made which represents particle size distribution by number classified into a plurality of classes on this abscissa with 0.23 intervals, the sum of the relative frequency ($m_1$) of toner particles included in the most frequent class in the histogram and the relative frequency ($m_2$) of toner particles included in the second most frequent class is 70% or more.

By developing the latent image formed on the above organic photoconductor with thin layer by the developer using the toner where the sum (M) of the relative frequency ($m_1$) and the relative frequency ($m_2$) is 70% or more, the image unevenness and the toner scatterings in text are prevented, and the favorable electrophotographic image with sharpness is obtained.

The histogram which represents the particle size distribution of the above number standard is the histogram in which the natural logarithm lnD (D: particle size of an individual toner particle) is assigned to a plurality of classes with 0.23 intervals (0 to 0.23: 0.23 to 0.46: 0.46 to 0.69: 0.69 to 0.92: 0.92 to 1.15: 1.15 to 1.38: 1.38 to 1.61: 1.61 to 1.84: 1.84 to 2.07: 2.07 to 2.30: 2.30 to 2.53: 2.53 to 2.76: . . . ) and which represents the particle size distribution of the above number standard. This histogram was made by forwarding particle size data measured by Coulter Multisizer according to the following condition to a computer through I/O unit and by particle size distribution analysis program in the computer.

[Measurement Condition]

(1) Aperture: 100 μm (2) Method for preparing samples: a surfactant (neutral detergent) at an appropriate amount is added to 50 to 100 ml of electrolytic solution [Isoton R-11 (supplied from Coulter Scientific Japan], stirred, and 10 to 20 mg of a measurement sample is added thereto. The sample is prepared by dispersing this system using a sonication dispersing machine.

c. 2. 4. Method for Producing Toner

It is preferred that the toner is the polymerization toner obtained by polymerizing at least a polymerizable monomer in an aqueous medium, and it is preferable to be the polymerization toner obtained by associating at least resin particles in the aqueous medium. Hereinafter, the method for producing the polymerization toner (hereinafter, also simply referred to as the toner) will be described in detail.

The polymerization toner can be produced by a suspension polymerization method or a method where fine polymer particles (resin particles) are prepared by emulsifying/polymerizing a monomer in a liquid (aqueous medium) to which a necessary additive of emulsifying solution is added and subsequently an organic solvent, a coagulant and the like are added to associate the resin particles. Here, "association" is referred to fusing the above a plurality of resin particles, and includes the case where the resin particle is fused with the other particle (e.g., coloring agent particle).

The polymerization toner means the toner formed by the generation of binder resin for the toner, polymerization of the raw material monomer where the toner form is the binder resin, and the subsequent chemical treatment if necessary. More specifically, it means the toner formed through the polymerization reaction such as suspension polymerization and emulsification polymerization, and the fusion step of particles one another, which is subsequently performed if necessary.

Showing one example of the methods for producing the polymerization toner, various construction materials such as a coloring agent, if necessary, a mold release agent, charge control agent and further a polymerization initiator are added into the polymerizable monomer, and the various construction materials are dissolved or dispersed in the polymerizable monomer by a homogenizer, sand mill, sand grinder, sonication dispersing machine. This polymerizable monomer in which the various construction materials are dissolved or dispersed is dispersed as oil droplets with desired size as the toner in the aqueous medium containing a dispersion stabilizer by using a homomixer and homogenizer. Subsequently, the reaction is transferred to a reaction apparatus (agitation apparatus) where an agitation mechanism is an agitation wing mentioned below, and the polymerization reaction is carried forward by heating. After the end of reaction, the toner is prepared by eliminating the dispersion stabilizer, filtrating, washing and further drying.

The "aqueous medium" indicates one in which water is contained at least at 50% or more by mass.

Also, the method for producing the polymerization toner can also include the method for preparing by associating or fusing the resin particles in the aqueous medium. This method is not particularly limited, and can include, for example, the methods shown in JP-Tokukaihei-5-265252, JP-Tokukaihei-6-329947 and JP-Tokukaihei-9-15904. That is, the toner can be formed by the method for associating a plurality of dispersion particles of the resin particles and the construction materials such as coloring agent or a plurality of fine particles comprising the resin and the coloring agent and the like, in particular, by dispersing these in water using an emulsifier, subsequently salting out by adding a coagulant at not less than a critical aggregation concentration and simultaneously making particle sizes gradually grow as forming fused particles by heating/fusing at a temperature not less than a glass transition temperature of the formed polymer itself, then stopping the growth of particle sizes by adding a large amount of water when the aimed particle sizes are obtained, further controlling the shape by smoothing the particle surface with heating and agitating, and heating/drying those particles containing water in a fluid state. Here, an organic solvent that is infinitely soluble in water may be added in parallel with the coagulant.

Those used as the polymerizable monomer which constitutes the resin are styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene, methacrylate ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate, acrylate ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate, olefins such as ethylene, propels and isobutylene, halogen type vinyls such as vinyl chloride, vinylidene chloride, vinyl bromide, vinyl fluoride and vinylidene fluoride, vinyl esters such as vinyl propionate, vinyl acetate and vinyl benzoate, vinyl ethers such as vinylmethylether and vinylethylether, vinyl ketones such as vinylmethylketone, vinylethylketone and vinylhexylketone, N-vinyl compounds such as N-vinyl carbazole, N-vinyl indole and N-vinyl pyrrolidone, vinyl compounds such as vinyl naphthalene and vinyl pyridine, acrylate or methacrylate derivatives such as acrylonitrile, methacrylonitrile and acrylamide. These vinyl type monomers can be used alone or in combination.

Besides, it is more preferable to use those having ionic dissociation group in combination as the polymerizable monomers which constitute the resin. For example, they are those having substituents such as carboxyl group, sulfonate group and phosphate group as composing groups of the monomer, and specifically include acrylic acid, methacrylic acid, maleic acid, itaconic acid, cinnamic acid, fumaric acid, maleate monoalkylester, itaconate monoalkylester, styrene sulfonate, allylsulfosuccinate, 2-acrylamide-2-methylpropane sulfonate, acid phosphoxyethyl methacrylate, 3-chloro-2-acid phosphoxypropyl methacrylate, and the like.

Furthermore, by the use of multifunctional vinyls such as divinylbenzene, ethyleneglycol dimethacrylate, ethyleneglycol diacrylate, diethyleneglycol dimethacrylate, diethyleneglycol diacrylate, triethyleneglycol dimethacrylate, triethyleneglycol diacrylate, neopentylglycol dimethacrylate and neopentylglycol diacrylate, it is also possible to make the resin with crosslinking structure.

It is possible to polymerize these polymerizable monomers using a radical polymerization initiator. In this case, in the suspension polymerization, it is possible to use an oil-soluble polymerization initiator. This oil-soluble polymerization initiator can include azo type or diazo type polymerization initiators such as 2,2'-azobis-(2,4-valeronitrile), 2,2'-azobisisobutyronitrile, 1,1-azobis(cyclohexane-1-carbonitrile), 2,2-azobis-4-methoxy-2,4-dimethylvaleronitrile and azobisisobutyronitrile, peroxide type polymerization initiators such as benzoyl peroxide, methylethylketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-butylperoxycyclohexyl)propane and tris-(t-butylperoxy)triazine, and high molecular initiators having peroxide at side chains.

When using the emulsification polymerization method, it is possible to use a water soluble radical polymerization initiator. The water soluble polymerization initiator can include persulfate such as potassium persulfate and ammonium persulfate, azobisaminodipropane acetate, azobiscyano valeric acid and salts thereof, hydrogen peroxide and the like.

The dispersion stabilizer can include tricalcium phosphate, magnesium phosphate, zinc phosphate, aluminium phosphate, calcium carbonate, magnesium carbonate, calcium hydroxide, magnesium hydroxide, aluminium hydroxide, calcium metasilicate, calcium sulfate, barium sulfate, bentonite, silica, alumina, and the like. Additionally, it is possible to use those generally used as surfactants such as polyvinyl alcohol, gelatin, methylcellulose, sodium dodecylbenzenesulfonate, ethylene oxide adducts and higher alcohol sodium sulfate as the dispersion stabilizer.

As the excellent resins, those where a glass transition temperature is from 20 to 90° C. are preferable, and those where a softening point is from 80 to 220° C. are preferable. The glass transition temperature is measured by a differential scanning calorimetry, and the softening point can be measured by a Koka flow tester. Furthermore, as these resins, for the molecular weight measured by gel permeation chromatography, those where a number mean molecular weight (Mn) is from 1000 to 100000 and a weight mean molecular weight (Mw) is from 2000 to 1000000 are preferable. Moreover, as a molecular weight distribution, those where Mw/Mn is from 1.5 to 100, particularly from 1.8 to 70 are preferable.

The coagulant used when the above resin particles are associated in the aqueous medium is not particularly limited, and those selected from metal salts are suitably used. Specifically, salts of alkali metals such as sodium potassium and lithium as monovalent metals, as bivalent metals, e.g., salts of alkali earth metals such as calcium and magnesium, salts of bivalent metals such as manganese and copper, salts of trivalent metals such as iron and aluminium, and the like can be included. Specific salts can include sodium chloride, potassium chloride, lithium chloride, calcium chloride, zinc chloride, copper sulfate, magnesium sulfate, manganese sulfate and the like. These may be used in combination.

It is preferred that these coagulants is added at a concentration not less than the critical aggregation concentration. This critical aggregation concentration is an index for stability of an aqueous dispersion and indicates a concentration where aggregation occurs by adding the coagulant. This critical aggregation concentration greatly varies depending on emulsified components and a dispersant itself. It is described in, for example, "Kobunshi Kagaku 17, 601 (1960) written by Seizo Okamura et al., edited by the Society of Polymer Science. Japan" and the like, and the detailed critical aggregation concentration can be calculated. As another technique, the desired salt with varying concentrations is added to an aimed particle dispersion solution, ζ (zeta) potential of the dispersion solution is measured, and a salt concentration at which this value is changed can be made the critical aggregation concentration.

The addition amount of the coagulant could be not less than the critical aggregation concentration, but preferably 1.2 times or more, and more preferably 1.5 times or more of the critical aggregation concentration.

As a "solvent that is infinitely soluble in water" used along with the coagulant, those which do not dissolve the formed resin are selected. Specifically, it is possible to include alcohols such as methanol, ethanol, propanol, isopropanol, t-butanol, methoxyethanol and butoxyethanol, nitrites such as acetonitrile, and ethers such as dioxane. Particularly, ethanol, propanol and isopropanol are preferable.

The addition amount of this infinitely soluble solvent is preferably from 1 to 100% by volume based on a polymer-containing dispersion solution to which the coagulant has been added.

To make the particle shapes uniform, it is preferable to prepare and filtrate colored particles, and subsequently fluidize/dry slurry where 10% or more by mass of water based on the particles is present, and at that time, those having polar group in the polymer are particularly preferable. As the reason for it, it is believed that the water present exerts an effect of some swelling on the polymer where the polar group exists and thus the shapes are easily made uniform.

The toner contains at least the resin and the coloring agent, but if necessary, it is also possible to contain a mold release agent, a charge control agent and the like which are fixing property improvers. Moreover, external additives comprising inorganic fine particles, organic fine particles and the like may be added-to the toner particles where major ingredients are the above resin and coloring agent.

As the coloring agents used for the toner, it is possible to optionally use carbon black, magnetic bodies, dyes, pigments, and the like. As the carbon black, channel black, furnace black, acetylene black, thermal black, lamp black, and the like are used. As the magnetic bodies, it is possible to use strong magnetic metals such as iron, nickel and cobalt, alloys including these metals, compounds of strong magnetic metals such as ferrite and magnetite, alloys which include no strong magnetic metal but exhibit strong magnetism by treating with heat, e.g., alloys of type called Heusler alloys such as manganese-copper-aluminum and manganese-copper-tin, chromium dioxide and the like.

As the dyes, it is possible to use C.I. solvent red 1, 49, 52, 58, 63, 111 and 122, C.I. solvent yellow 19, 44, 77, 79, 81, 82, 93, 98, 103, 104, 112 and 162, C.I. solvent blue 25, 36, 60, 70, 93 and 95, and the like, and mixtures thereof. As the pigments, it is possible to use C.I. pigment red 5, 48:1, 53:1, 57:1, 122, 139, 144, 149, 166, 177, 178 and 222, C.I. pigment orange 31 and 43, C.I. pigment yellow 14, 17, 93, 94, and 138, C.I. pigment green 7, C.I. pigment blue 15:3 and 60, and the like, and mixtures thereof. A number average primary particle size varies depending on types, but is preferably from about 10 to 200 nm.

As the method for adding the coloring agent, it is possible to use the method for coloring the polymer by adding the polymer particles prepared by the emulsification polymerization method at a stage of aggregating by adding the coagulant, the method for making colored particles by adding the coloring agent at a stage where the monomer is polymerized and polymerizing, and the like. When the coloring agent is added at the stage where the polymer is prepared, it is preferred that the coloring agent is used by treating the surface with a coupling agent and the like not to inhibit radical polymerization property.

Additionally, as the fixing property improver, low molecular weight polypropylene (number average molecular weight=1500 to 9000), low molecular weight polyethylene or the like may be added.

Likewise, as the charge control agent, it is possible to use those known and capable of being dispersed in water. Specifically, nigrosine dyes, metal salts of naphthenic acid or higher fatty acid, alkoxylated amine, quaternary ammonium salt compounds, azo type metallic complexes, and salicylate metal salts or metallic complexes thereof are included.

For particles of these charge control agent and fixing property improver, it is preferred that the number average primary particle size is from about 10 to 500 nm in a dispersed state.

In the toner, it is possible to further exert the effects by adding and using fine particles of inorganic and organic fine particles as the external additive. As the reason for this, it is presumed that since flanking and detachment of the external additive are effectively inhibited, its effects are noticeably exerted.

As this inorganic fine particle, the use of inorganic oxide particles of silica, titania, alumina, and the like is preferable. Furthermore, it is preferred that a hydrophobizing treatment is given to these inorganic fine particles by a silane coupling agent, a titanium coupling agent or the like. A level of the hydrophobizing treatment is not particularly limited, and those where methanol wettability is from 40 to 95 are preferable. The methanol wettability is one where wettability for methanol is evaluated. In this method, 0.2 g of the inorganic fine particles subjected to the measurement is weighted and added to 50 ml of distilled water placed in a 200 ml content beaker. Methanol from a burette of which extremity is immersed in the liquid is slowly dripped with slowly stirring until whole inorganic fine particles are wetted. When the amount of methanol required for wetting the whole inorganic fine particles is a (ml), a hydrophobizing degree is calculated by the following formula.

$$\text{Hydrophobizing degree}=(a/(a+50))\times 100$$

The addition amount of this external additive is from 0.1 to 5.0% and preferably from 0.5 to 4.0% by mass in the toner. As the external additive, various matters may be used in combination.

In the suspension polymerization process toner where the toner is obtained by suspending one where the toner construction materials such as coloring agent are dispersed or dissolved in the so-called polymerizable monomer in the aqueous medium and then polymerizing, the shape of toner particles can be controlled by controlling flow of the medium in a reaction vessel in which the polymerization reaction is performed. That is, when many toner particles having the shape where the shape coefficient is 1.2 or more are formed, coalescence of the particles is promoted and the particles with undefined shape are obtained by making the flow of medium in the reaction vessel an eddy flow and performing collision of the particles at the time point when oil droplets become soft particles by gradually making the oil droplets present in the aqueous medium high molecules in a suspension state where the polymerization progresses. Also, when nearly spherical toner particles where the shape coefficient is less than 1.2, the nearly spherical particles are obtained by making the flow of medium in the reaction vessel a laminar flow and avoiding the collision of particles. By this method, it is possible to control the distribution of toner shapes. within the invention.

c. 2. 5. Apparatus for Producing Toner

Figure 3:
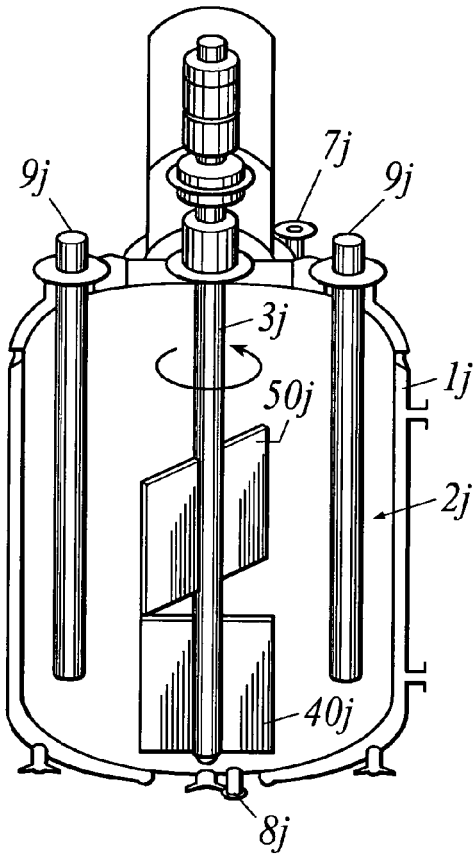
FIG. 3 is a perspective view showing an example of a polymerization toner reaction apparatus.
Figure 4:
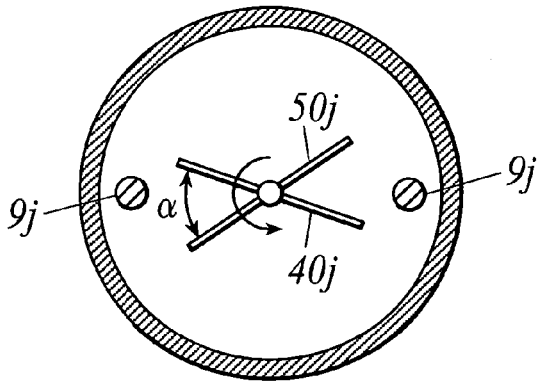
FIG. 4 is a sectional view showing an example of a polymerization toner reaction apparatus.

Next, a reaction apparatus suitably used for producing the polymerization toner will be illustrated. FIGS. 3 and 4 are a perspective view and a sectional view, respectively showing one example of a polymerization toner reaction apparatus. In the reaction apparatus shown in FIGS. 3 and 4, a rotational axis 3*j* is vertically provided at a center section in a vertical cylindrical agitation vessel 2*j* equipped with a jacket 1*j* for heat exchange at a peripheral section, and a lower agitation wing 40*j* arranged close to a bottom face of the agitation vessel 2*j* and an agitation wing 50*j* arranged at an upper site are placed at the rotational axis 3*j*. The upper agitation wing 50*j* is arranged with a crossed axes angel a which precedes in a rotation direction for the agitation wing 40*j* located at a lower site. When the toner is produced, it is preferred that the crossed axes angle $\alpha$ is less than 90°. A lower limit of this crossed axes angel $\alpha$ is not particularly limited, but is preferably about 5° or more, and more preferably 10° or more. When agitation wings in triple construction are placed, it is preferred that the crossed axes angle $\alpha$ between adjacent agitation wings is less than 90°.

By making such a construction, the medium is first agitated by the agitation wing 50*j* arranged at the upper site, and downward flow is formed. Then, it is presumed that the flow formed by the agitation wing 50*j* at the upper site is further accelerated downward by the agitation wing 40*j* provided at the lower site as well as downward flow is separately formed at this agitation wing 50*j* per se and the flow is totally accelerated and carried forward. Consequently, it is presumed that the shapes of the resulting toner particles can be controlled because a flow area having a large shear stress formed as the eddy flow is formed.

In FIGS. 3 and 4, arrows represent the rotation directions, 7*j* is an upper material inlet, 8*j* is a lower material inlet, and 9*j* is an eddy flow formation member for making the agitation effective.

Figure 5A:
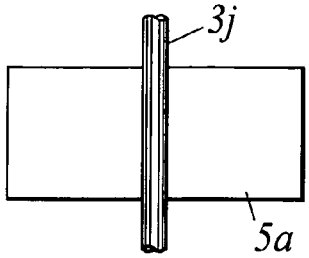
FIG. 5A, FIG. 5B, FIG. 5C and FIG. 5D are schematic views showing a specific example of a shape of agitation wings, respectively.
Figure 5B:
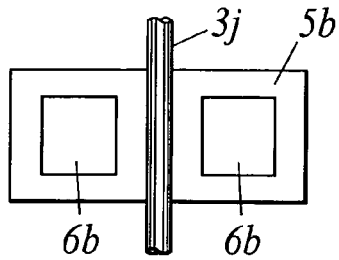
Figure 5C:
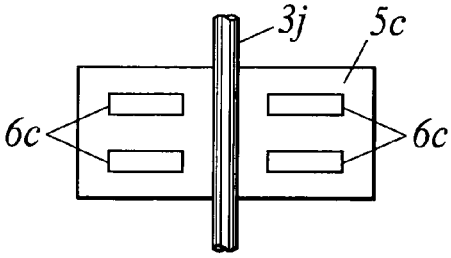
Figure 5D:
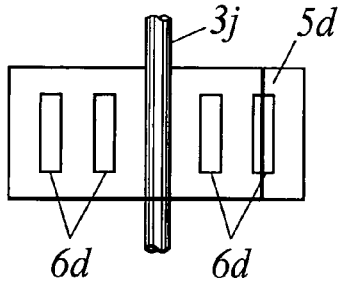

Here, shapes of the agitation wing are not particularly limited, and it is possible to use those which are rectangle platy, those where there are crenas at parts of the wing, those where there are one or more mid-holes, i.e., slits at the center section, and the like. Specific examples of these are described in FIG. 5A to 5D. The agitation wing 5*a* shown in FIG. 5A is one with no mid-hole, the agitation wing 5*b* shown in FIG. 5B is one with large mid-holes 6*b* at the center, the agitation wing 5*c* shown in FIG. 5C is one with horizontally long mid-holes 6*c* (slits), and the agitation wing shown in FIG. 5D is one with vertically long mid-holes 6*d* (slits). When the agitation wings in triple construction are placed, the mid-hole formed in the upper agitation wing and the mid-hole formed in the lower agitation wing may be different or the same.

A space between the upper and lower agitation wings having the above construction is not particularly limited, but it is preferable to have at least the space between the agitation wings. This reason is not clear, but it is believed that agitation efficiency is improved because the flow of the medium is formed through the space. But, the space has from 0.5 to 50% width, and preferably from 1 to 30% width based on a height of a liquid level at a static state.

Furthermore, the size of the agitation wing is not particularly limited, and a total sum of heights of all agitation wings is from 50 to 100%, and preferably from 60 to 95% based on the height of liquid level at the static state.

Meanwhile, in the polymerization process toner where the resin particles are associated or fused in the aqueous medium, it is possible to arbitrarily change the shape distribution and the shape of whole toner by controlling the flow of medium and temperature distribution in the reaction vessel at the fusion stage, and further by controlling the heating temperature, the agitation rotation frequency and the time period in the step of shape controlling after the fusion.

That is, in the polymerization process toner where the resin particles are associated or fused, it is possible to form the toner having the desired shape coefficient and uniform shape distribution by making the flow in the reaction apparatus the laminar flow, using the agitation wing(s) and agitation vessel where inside temperature can be uniformized, and controlling the temperature, the rotation frequency and the time period at the steps of fusing and shape controlling. For this reason, it is presumed that when fused at the field where the laminar flow is formed, no strong stress is added to the particles (associated or aggregated particles) where the aggregation and fusion progress, and the temperature distribution in the agitation vessel is uniform in the laminar flow where the flow is accelerated, and consequently the shape distribution of the fused particles becomes uniform. Furthermore, the fused particles are gradually conglobated by heating and agitating at the subsequent step of shape controlling, and the shapes of toner particles can be arbitrarily controlled.

As the agitation vessel used when producing the polymerization process toner where the resin particles are associated or fused, it is possible to use the same vessel as that in the above suspension polymerization method. In this case, it is better not to place an obstacle such as a baffle plate which forms the eddy flow in the agitation vessel.

The shape of this agitation wing is not also particularly limited so long as it forms the laminar flow and does not form the eddy flow. Those such as a rectangular plate shown in FIG. 5C, which are formed by a continuous face are preferable, and may have a curved surface.

d. Image Forming Method and Image Forming Apparatus

Next, the image forming method or apparatus will be described.

Figure 6:
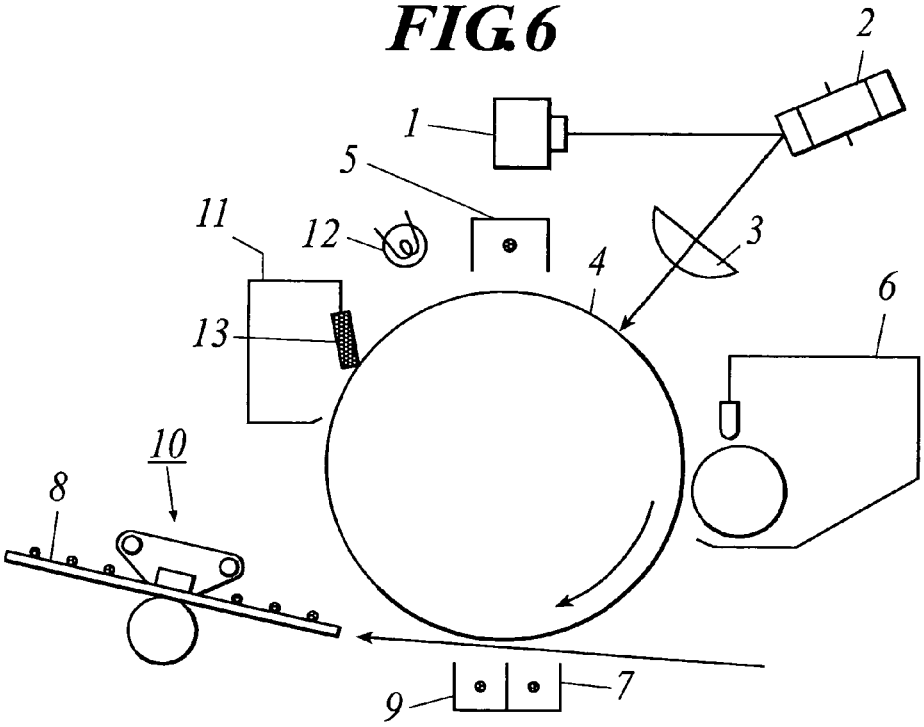
FIG. 6 is a schematic construction view of an image forming apparatus.

In FIG. 6, a schematic illustration of the image forming apparatus representing one embodiment example is shown. Numeral reference 4 is an organic photoconductor (OPC), is made by forming an organic photo conductive layer which is a photoconductor layer on a peripheral surface of a drum base substance made of aluminium, and rotates in an arrow direction at a predetermined speed. In the present embodiment, the photoconductor 4 has an external diameter of 60 mm.

In FIG. 6, based on information read out at a draft reading apparatus which is not shown in the figure, exposure light is emitted from a semiconductor laser light source 1. This is allotted to a vertical direction against a paper surface in FIG.

6 by a polygon mirror 2, and irradiated on the photoconductor surface through an fθ lens 3 which corrects distortion of an image to make an electrostatic latent image. The photoconductor has been uniformly electrized precedently by a charging tool 5, and started to rotate clockwise in line with a timing of image exposure.

The electrostatic latent image on the photoconductor surface is developed by a development tool (also development step) 6, and a formed developed image is transferred on an image support 8 fed in line with the timing by an action of a transfer tool 7. Furthermore, the photoconductor 4 and the image support 8 are separated by a separation tool (separation pole) 9, and a toner developed image is transferred/retained on the image support 8, led to a fixation tool 10, and fixed.

Untransferred toner and the like left on the photoconductor surface are cleaned by a cleaning tool 11 of a cleaning blade process, residual charge is eliminated at a pre-charging light exposure (PCL) 12, and the photoconductor surface is uniformly charged again by the charging tool 5 for next image formation.

The image support is representatively plain paper, but is not particularly limited so long as an unfixed image after the development can be transferred, and it is no doubt to include PET bases for OHP and the like.

A rubber elastic body with thickness of about 1 to 30 mm is used for the cleaning blade 13, and as a material, urethane rubber is most frequently used.

Beams irradiated from a scanning optical system mentioned above have a rounded or elliptic luminance distribution approximated to a normal distribution where bottoms extend from side to side. For example, in the case of laser beams, they are extremely small circle or elliptic shapes where one or both of a major scanning direction and a minor scanning direction on the photoconductor is typically from 20 to 100 μm.

In the usage, a preferable development process is particularly a contact development where a distance between a development sleeve and an electrostatic latent image-forming body (photoconductor) is narrower than the thickness of a development layer. Also, a vibratory electric field may be given to a development region.

Figure 7:
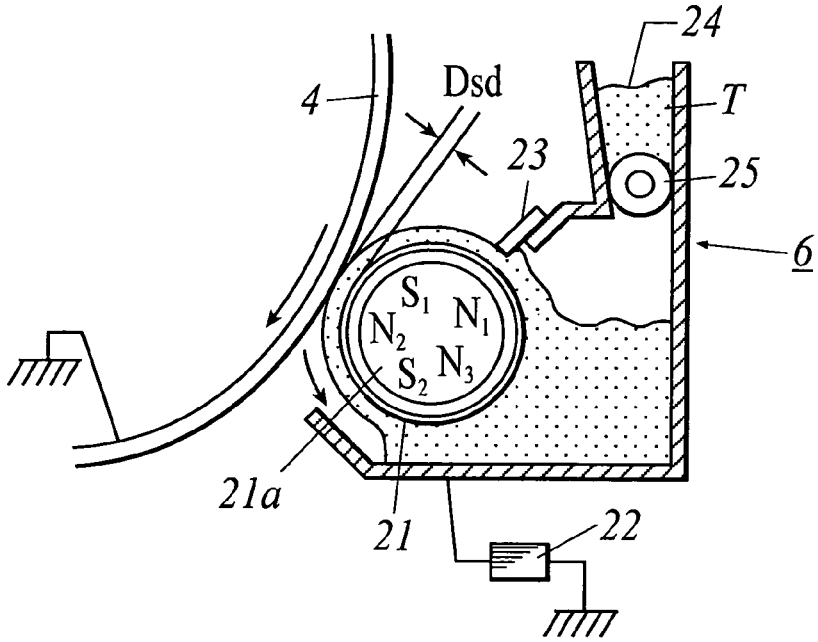
FIG. 7 is a sectional view showing one example of a development tool.

FIG. 7 is a sectional view showing one example of the development tool 6 used for performing the development method of this invention.

As for the development tool 6 shown in FIG. 7, the developer comprising the toner T and the carrier is accommodated in the inside thereof, as the development sleeve (developer feeding member) 21 which feeds this developer, using the cylindrical development sleeve where a magnet roller 21*a* comprising a plurality of magnetic poles $N_1$, $S_1$, $N_2$, $S_2$ and $N_3$ is placed inside, this development sleeve is rotatably disposed to oppose to the photoconductor 4 at an appropriate space Dsd in the development region. The development sleeve 21 is rotated in an opposite direction of the photoconductor 4, that is, it is rotated such that the development sleeve 21 and the photoconductor 4 move in the same direction at the development region where the development sleeve 21 opposes to the photoconductor 4. Along with the rotation of this development sleeve 21, the developer 20 accommodated in the development tool 6 is fed to the photoconductor side in a magnetic brush state by magnetic attraction action of the magnetic roller 21*a*.

Also, the above development sleeve 21 is connected to a development bias electric power supply 22, and development bias voltage of alternating current voltage or direct current voltage superimposed onto the alternating current voltage is impressed from this development bias electric power supply 22 to act the vibratory electric field upon the development region. As the vibratory electric field, it is preferred that a relation of the space Dsd between the development sleeve and the photoconductor with a peak-peak value (Vp−p) of the alternating current voltage is 3 kV/mm≦(Vp−p/Dsd)≦5 kV/mm.

Also, at an upstream side of the feeding direction of the developer from the development region where the above development sleeve 21 opposes to the photoconductor 4, a magnetic blade 23 is placed at a location which opposes to the magnetic pole N1 of the above magnetic roller 21*a* at a necessary distance from the development sleeve 21, and this magnetic blade 23 regulates an amount of the developer on the development sleeve 21.

In this development tool 6, a toner accommodating section 24 in which the toner T is accommodated is placed at an upper part thereof. The development is performed by supplying the toner T in the developer from the development sleeve 21 to the photoconductor 4. As a result, when a concentration of the toner T in the developer in the development tool 6 is reduced, the toner T accommodated in the toner accommodating section 24 is resupplied into the development tool 6 by rotating a toner resupply roller 25 placed beneath this toner accommodating section 24.

And, a feeding amount of the developer is regulated by the development sleeve 21 in this way, subsequently this developer is led by the development sleeve 21 to the development region which opposes to the photoconductor 4, and the development is performed by impressing the bias voltage from the above development bias electric power supply 22 to act the vibratory electric field upon this development field and supplying the toner T in the developer fed by the development sleeve 21 from the development sleeve 21 to a latent image part of the photoconductor 4.

Also, it is possible to make the above image forming apparatus a form which carries a process cartridge comprising the photoconductor 4 and at least one of the charging tool 5, the development tool 6, the cleaning tool 11, a transfer tool 7 and the like.

Figure 8A:
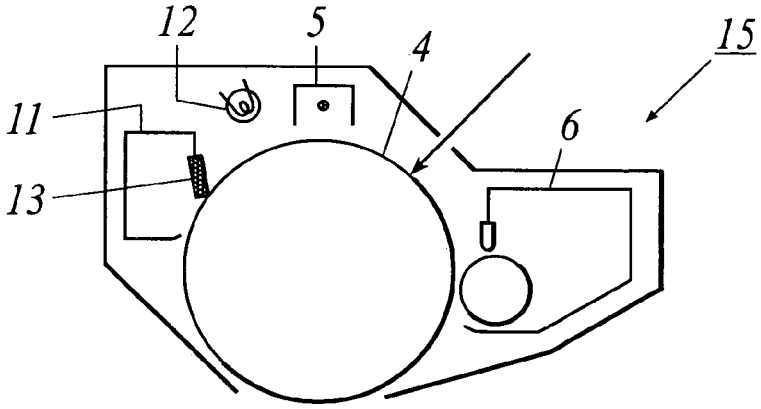
FIG. 8A is a sectional view of a process cartridge.
Figure 8B:
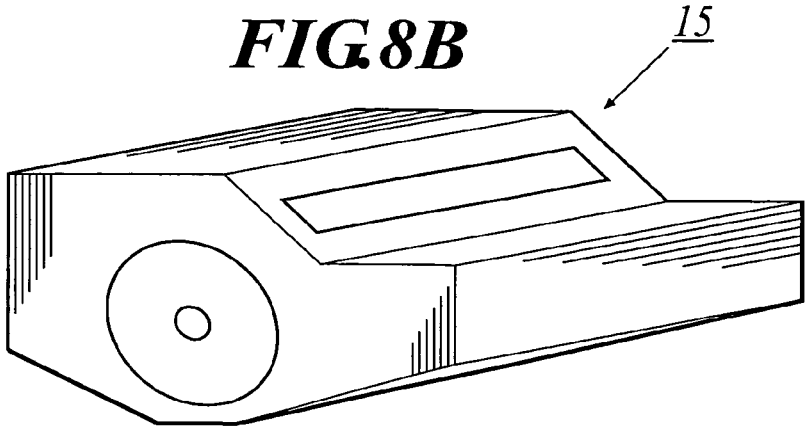
FIG. 8B is a perspective view of the process cartridge.

An example of the process cartridge for carrying on the image forming apparatus was shown as a sectional view in FIG. 8A and a perspective view in FIG. 8B. This process cartridge 15 is loaded in the apparatus from the side face of the image forming apparatus, i.e., from the vertical direction against the direction in which the image support is fed through a guide rail and the like.

As is evident from FIGS. 8A and 8B, in this example, the process cartridge is formed by housing the photoconductor 4 at the center, the charging tool 5, the development tool 6, the cleaning tool 11 and PCL 12 in the process cartridge 15 as one unit. Taking such a form of the process cartridge can be said to be one preferable embodiment.

As the fixation tool 10, it is possible to use various ones including a heat roller mode. Also, if necessary, a cleaning mechanism may be imparted. In this case, it is possible to use a method for cleaning by supplying a pad, roller, web and the like in which the silicone oil is impregnated, as the mode of supplying silicone oil to a roller of the fixation tool As the silicone oil, those with high heat resistance are used, and polydimethylsilicone polyphenylmethylsilicone, polydiphenylsilicone and the like are used. As for those with a low viscosity, an outflow amount at the use is increased. Therefore those with viscosity of 1 to 100 Pa·s at 20° C. are suitably used. It is preferred that a coating amount of the silicone oil is from 0.1 to 10 μg/cm$^2$.

EXAMPLES

Hereinafter, the invention will be described in detail by taking examples, but the aspects of the invention are not limited thereto. "Part" in the following sentences represents "part by mass".

a. Manufacture of Photoconductor 1

A photoconductor 1 was made as follows.

a. 1. Conductive Support

A conductive support with surface roughness Rz=1.5 (μm) was prepared by cutting a surface of a cylindrical aluminum support with a diameter of 100 mmϕ and a length of 346 mm.

a. 2. Intermediate Layer

An intermediate layer coating solution was made by diluting the following intermediate layer dispersion solution at two times with the same mixed solvent, left overnight, and subsequently filtrating (filter: Rigi-Mesh 5 μm filter supplied from Pall Corporation Japan).

| | |
|---|---|
| Polyamide resin CM 800 (supplied from Toray Industries, Inc. | 1 part; |
| titanium oxide (number average particle size 35 nm: silica/alumina treated and methylhydrogen polysiloxane treated titanium oxide) | 3 parts; |
| and | |
| methanol | 10 parts |
| were mixed and dispersed for 10 hours in a batch mode using a sand mill as a dispersing machine to make the intermediate dispersion solution. The above coating solution was applied to the above support such that a dried film thickness became 1.5 μm. | |

a. 3. Photosensitive Layer a. 3. 1. Charge Generation Layer (CGL)

| | |
|---|---|
| Charge generation material (Titanyl phthalocyanine pigment (titanyl phthalocyanine pigment having noticeable peaks at 7.5° and 28.6° in F: diffraction angel of Cu-Kα specific X-ray: Bragg angle 2θ)) | 60 parts; |
| polyvinyl butyral resin (BL-S: supplied from Sekisui Chemical Co., Ltd.) | 700 parts; |
| and | |
| 2-butanone | 2000 parts |
| were mixed and dispersed for 30 hours using the sand mill to prepare a charge generation layer coating solution. This coating solution was applied to the above intermediate layer by a dip coating method to form the charge generation layer with a dried film thickness of 0.5 μm. | |

a. 3. 2. Charge Transfer Layer (CTL)

| | |
|---|---|
| Charge transfer material (4,4-dimethyl-4"-(α-phenylstyryl)triphenylamine) | 225 parts; |
| polycarbonate (Z300: supplied from Mitsubishi Chemical Corporation) | 300 parts; |
| antioxidant (Irganox 1010: supplied from Ciba-Geigy Japan) | 6 parts; |
| dichloromethane | 2000 parts; |
| and | |
| silicone oil (KF-54: supplied from Shin-Etsu Chemical Co., Ltd.) | 1 part |
| were mixed and dissolved to prepare a charge transfer layer coating solution 1. This coating solution was applied to the above charge generation layer by the dip coating method, and dried at 110° C. for 70 min to form the charge transfer layer with a dried film thickness of 10 μm. | |

-continued a. 4. Preparation of Tetrafluoroethylene Resin Particle Dispersion Solution

| | |
|---|---|
| Tetrafluoroethylene resin particles (Lubron L-2, supplied from Daikin Industries, Ltd.) | 200 parts; |
| polycarbonate (Z300: supplied from Mitsubishi Gas Chemical Campany) | 200 parts; |
| monochlorobenzene | 600 parts; |
| and | |
| fluorine type comb-like graft polymer (brand name GF300: supplied from TOA Chemical Industries Ltd.) | 8 parts |
| were mixed, and subsequently dispersed by a sand grinder (supplied from Amex) using glass beads to prepare the tetrafluoroethylene resin particle dispersion solution. | |

a. 5. Protection Layer

| | |
|---|---|
| Tetrafluoroethylene resin particle dispersion solution | 1500 parts; |
| charge transfer material (4,4'-dimethyl-4"-(α-phenylstyryl)triphenylamine) | 1225 parts; |
| polycarbonate (Z300: supplied from Mitsubishi Chemical Corporation) | 800 parts; |
| antioxidant (Irganox 1010: supplied from Ciba-Geigy Japan) | 12 parts; |
| dichloromethane | 3000 parts; |
| monochlorobenzene | 5000 parts; |
| and | |
| silicone oil (KF-54: supplied from Shin-Etsu Chemical Co., Ltd.) | 4 parts |
| were mixed and dissolved to prepare the charge transport layer coating solution 2. This coating solution was applied to the above charge transport layer by using a round slide hopper type coating machine, and dried at 110° C. for 70 min to form the protection layer with dried film thickness of 2 μm, and the photoconductor 1 was made. | |

a. 6. Manufacture of Photoconductors 2 to 9

The photoconductors 2 to 9 were made as is the case with the photoconductor 1, except that titanium oxide in the intermediate layer, the film thickness of the charge generation layer (CGL), the film thickness of the charge transport layer and the protection layer, and fluorine type resin particles were changed to those in Table 1.

a. 7. Manufacture of Photoconductor 10

The photoconductor 10 was made as is the case with the photoconductor 1, except for eliminating the protection layer.

TABLE 1

| Photoconductor No. | Immediate layer: Number average particle size of titanium oxide (nm) | Immediate layer: Surface treatment of titanium oxide | Immediate layer: Thickness (μm) | Thickness of CGL | Thickness of CTL | Protective layer: Fluororesin particle (type and amount (part)) | Protective layer: Thickness | Total thickness of CGL, CTL and protective layer (μm) |
|---|---|---|---|---|---|---|---|---|
| 1 | 35.0 | A | 1.5 | 0.5 | 10.0 | G(200) | 2.0 | 12.5 |
| 2 | 35.0 | A | 1.5 | 0.5 | 12.5 | G(200) | 2.0 | 15.0 |
| 3 | 35.0 | A | 1.5 | 0.5 | 4.0 | G(200) | 2.0 | 6.5 |
| 4 | 35.0 | A | 1.5 | 0.5 | 14.5 | G(200) | 1.0 | 16.0 |
| 5 | 35.0 | A | 1.5 | 0.5 | 2.5 | G(200) | 1.0 | 4.0 |
| 6 | 70.0 | B | 1.5 | 0.3 | 12.5 | H(100) | 1.0 | 13.8 |
| 7 | 140.0 | C | 1.5 | 1.0 | 8.0 | H(100) | 2.0 | 11.0 |
| 8 | 35.0 | A | 1.5 | 2.0 | 10.0 | H(100) | 2.0 | 14.0 |
| 9 | 35.0 | A | 1.5 | 0.5 | 5.5 | G(200) | 2.0 | 8.0 |
| 10 | 35.0 | A | 1.5 | 0.5 | 10.0 | — | 0.0 | 10.5 |

In Table 1, the surface treatments A, B and C of fine particles represent the following treatments.

A: Silica/alumina treatment and methylhydrogen polysiloxane treatment;

B: Silica/alumina treatment and octyl trimethoxysilane treatment;

C: Silica/zirconia treatment and methyl trimethoxysilane treatment.

G and H represent the following fluorine type resin fine particles.

G: Tetrafluoroethylene resin particle (Lubron L-2, supplied from Daikin Industries, Ltd.)

H: Trifluoroethylene resin particle (Daiflon, supplied from Daikin Industries, Ltd.)

b. Manufacture of Toner and Developer b. 1. Manufacture of Toner b. 1. 1. Toner Manufacture Example 1: Example of Emulsification Polymerization Association Method 0.90 kg of n-Dodecyl sulfate and 10.0 L of pure water were placed, and stirred to be dissolved. To this solution, 1.20 kg of Regal 330R (carbon black supplied from Cabot Corporation) was gradually added, thoroughly stirred for one hour, and subsequently dispersed continuously for 20 hours using a sand grinder (medium type dispersion machine). This is rendered a "coloring agent dispersion solution 1".

A solution composed of 0.055 kg of sodium dodecyl benzenesulfonate and 4.0 L of ion-exchange water is rendered an "anionic surfactant solution A".

A solution composed of 0.014 kg of 10 mol nonylphenolpolyethyleneoxide adduct and 4.0 L of ion-exchange water is rendered a "nonionic surfactant solution B".

A solution in which 223.8 g of potassium persulfate is dissolved in 12.0 L of ion-exchange water is rendered an "initiator solution C".

Into a GL (glass lining) reaction vessel with volume of 100 liters equipped with a thermal sensor, a cooling tube and a nitrogen introduction device, 3.41 kg of wax emulsion (polypropylene emulsion with number average molecular weight of 3000; number average primary particle size=120 nm/solid content concentration=29.9%) and whole amounts of the "anionic surfactant solution A" and "nonionic surfactant solution B" were placed, and started to stir. Then, 44.0 liters of ion-exchange water was added.

Heating was started, and when a liquid temperature reached 75° C., the whole amount of "initiator solution C" was added by dripping. Subsequently, as the liquid temperature is controlled at 75° C. ±1° C., 12.1 kg of styrene, 2.88 kg of n-butyl acrylate, 1.04 kg of methacrylic acid and 548 g of t-dodecyl mercaptan were put in by dripping. After the completion of dripping, the liquid temperature was elevated to 80° C. ±1° C., and heating and stirring were performed for 6 hours. Then, the liquid temperature was cooled to 40° C. or below, the stirring was stopped, and the solution was filtrated with a pole filter to yield latex. This is rendered "latex-A".

For the resin particles in the latex-A, the glass transition temperature was 57° C., the softening point was 121° C., and the molecular weight distribution had the weight average molecular weight=12.7 thousands and the weight average particle size (D4) was 120 nm.

A solution in which 0.055 kg of sodium dodecyl benzenesulfonate is dissolved in 4.0 L of ion-exchange water is rendered an "anionic surfactant solution D".

A solution in which 0.014 kg of 10 mol nonylphenolpolyethyleneoxide adduct is dissolved in 4.0 L of ion-exchange water is rendered a "nonionic surfactant solution E".

A solution in which 200.7 g of potassium persulfate is dissolved in 12.0 L of ion-exchange water is rendered an "initiator solution F".

Into a GL reaction vessel with volume of 100 liters equipped with a thermal sensor, a cooling tube, a nitrogen introduction device and a comb-like baffle, 3.41 kg of wax emulsion (polypropylene emulsion with number average molecular weight of 3000; number average primary particle size=120 nm/solid content concentration=29.9%) and whole amounts of the "anionic surfactant solution D" and "nonionic surfactant solution E" were placed, and started to stir.

Then, 44.0 liters of ion-exchange water was added. Heating was started, and when the liquid temperature reached 70° C., the "initiator solution F" was added. Then, a solution in which 11.0 kg of styrene, 4.00 kg of n-butyl acrylate, 1.04 kg of methacrylic acid and 9.02 g of t-dodecyl mercaptan were precedently mixed was dripped. After the completion of dripping, the liquid temperature was controlled to 72° C. ±2° C., and heating and stirring were performed for 6 hours. Furthermore, the liquid temperature was elevated to 80° C.±2° C., and heating and stirring were performed for 12 hours. The liquid temperature was cooled to 40° C. or below, the stirring was stopped. The solution was filtrated with a pole filter, and this filtrate is rendered "latex-B".

For the resin particles in the latex-B, the glass transition temperature was 58° C., the softening point was 132° C., and the molecular weight distribution had the weight average molecular weight=245 thousands and the weight average particle size (D4) was 110 nm.

A solution in which 5.36 kg of sodium chloride as a salting out agent is dissolved in 20.0 liters of ion-exchange water is rendered a "sodium chloride solution G".

A solution in which 1.00 g of fluorine type nonionic surfactant is dissolved in 1.00 liter of ion-exchange water is rendered a "nonionic surfactant solution H".

Into an SUS reaction vessel (reaction apparatus of the construction shown in FIG. 3, the crossed axes angle α is 25°) of 100 liters equipped with the thermal sensor, the cooling tube, the nitrogen introduction device and a particle-size-and-shape monitoring device, the latex-A=20.0 kg and latex-B=5.2 kg and the coloring agent dispersion solution 1=0.4 kg made above and 20.0 kg of ion-exchange water were placed and stirred. Then, the temperature was elevated to 40° C., and the sodium chloride solution G, 6.00 kg of isopropanol (supplied from Kanto Kagaku Co.) and the nonionic surfactant solution H were added in this sequence. Subsequently, after leaving for 10 min, rising temperature was started, the liquid temperature was elevated to 85° C. in 60 min, and at 85° C.±2° C., heating/stirring was performed for 0.5 to 3 hours to grow the particle sizes with salting out/fusing (step of salting out/fusing). Next, 2.1 liters of pure water was added to stop the growth of particle sizes and make a fused particle dispersion solution.

Into a reaction container (reaction apparatus of the construction shown in FIG. 3, the crossed axes angle a is 20°) of 5 liters equipped with the thermal sensor, the cooling tube and a particle-size-and-shape monitoring device, 5.0 kg of the fused particle dispersion solution made above was placed, and at 85° C. ±2° C., heating and stirring were performed for 0.5 to 15 hours to control shapes (step of shape controlling). Subsequently, the temperature was cooled to 40° C. or below, and the stirring was stopped. Next using a centrifuge machine, classification was performed in the solution by a centrifugal setting method. The solution was passed through a sieve with opening of 45 μm, and this filtrate is rendered an association solution. Then, using a Nutshe, wet cake-like non-spherical particles were filtered from the an association solution, and subsequently washed with ion-exchange water. These non-spherical particles were dried at an intake air temperature of 60° C. using a flash jet dryer, and then dried at the temperature of 60° C. using a fluidized-bed dryer. To 100 parts by mass of resulting colored particles, 1.0% by mass of hydrophobic silica (number average primary particle size=20 nm, hydrophobizing degree=68) and 0.3% by mass of hydrophobic titanium oxide (number average primary particle size=200 nm, hydrophobizing degree=63) were added and mixed to obtain the toner by the emulsification polymerization association method.

b. 1. 2. Manufacture of Toners 1 to 6

The toners 1 to 6 made up of the toner particles having shape properties and particle size distribution properties shown in Table 2 were obtained by controlling variation coefficients of the shapes and the shape coefficients by controlling a stirring rotation frequency and a heating time period in the monitoring at the above steps of salting out/fusing and shape controlling, and by further arbitrarily regulating variation coefficients of the particle sizes and particle size distribution by the classification in the solution.

TABLE 2

| Toner No. | Percentage of toner particle with shape coefficient of 1.2 to 1.6 (%) | $M(m_1 + m_2)$ | Percentage of toner particle with no corner (%) | Number average particle size of toner particle (μm) |
|---|---|---|---|---|
| 1 | 66.3 | 80.7 | 88 | 5.6 |
| 2 | 73.2 | 82.3 | 94 | 8.1 |
| 3 | 65.1 | 71.4 | 52 | 3.7 |
| 4 | 63.4 | 70.5 | 51 | 5.3 |
| 5 | 65.1 | 67.4 | 51 | 5.6 |
| 6 | 60.5 | 68.3 | 42 | 5.7 |

b. 2. Manufacture of Carrier b. 1. Manufacture Example of Magnetic Carrier 1

In a one liter flask, 125 g of phenol, 187.5 g of 37% formalin, 1 kg of spherical magnetite particle powder with an average particle size of 0.24 μm of which surface was treated with a silane type coupling agent having epoxy group, 37.5 g of 25% aqueous ammonia and 125 g of water were placed, and the temperature was elevated to 85° C. in 60 min with stirring. Subsequently, by reacting and hardening at the same temperature for 120 min, magnetic particles were produced where magnetite particles were dispersed in the phenol resin.

Next, a content in the flask was cooled to 30° C., subsequently, the content was transferred to a 3 liter flask, and 1.5 liters of water was added thereto. Then, a supernatant solution was removed, a lower precipitate was washed with water, and dried in air.

Then, this was dried under reduced pressure (5 mmHg or less) at 150 to 180° C. to yield the magnetic particles 1.

Next, the magnetic particles 1 are placed in a universal stirring machine (5XDML, supplied from Dalton Corporation), and stirred until an article temperature becomes 50° C. Next, a solution in which 0.3% by mass of silane coupling agent KBM-602 having amino group (Shin-Etsu Chemical Co., Ltd.) was dissolved in methanol was added, the temperature was elevated until the article temperature became 70° C., stirring was performed at the same temperature for 2 hours, and particle surfaces of the magnetic particles were coated with the silane coupling agent having amino group to produce a magnetic carrier 1. For the magnetic carrier 1, the weight average particle size (D4) was 35 μm, the specific gravity was 3.53, a bulk density was 1.88 g/ml, an electric resistance value was $6\times10^{11}$ Ωcm, a magnetizing value (σ79.58) was 29 $Am^2/kg$, and a residual magnetizing value (σr) was 3.0 $\mu m^2/kg$.

b. 2. 2. Manufacture of Magnetic Carriers 2 to 5

The magnetic carriers 2 to 5 of which weight average particle sizes (D4) were 20 μm, 48 μm, 55 μm and 10 μm, respectively were made by changing the amount of 25% the aqueous ammonia and water, reaction conditions and hardening conditions in the manufacture process of the magnetic particle 1.

b. 3. Manufacture of Developers b. 3. 1. Preparation of Developers 1 to 10

Developers 1 to 10 in which toner concentration was 6% were prepared by combining and mixing the above toners 1 to 6 and the magnetic carriers 1 to 5.

The prepared developers are shown as a list in Table 3 below.

TABLE 3

| Developer No. | Toner No. | Carrier No. |
|---|---|---|
| 1 | 1 | 1 |
| 2 | 1 | 2 |
| 3 | 1 | 3 |
| 4 | 1 | 4 |
| 5 | 1 | 5 |
| 6 | 2 | 6 |
| 7 | 3 | 7 |
| 8 | 4 | 8 |
| 9 | 5 | 9 |
| 10 | 6 | 10 |

c. Evaluation 1

Actual photographing evaluation was carried out by combining the above photoconductors 1 to 10 and the developers 1 to 10 as shown in Table 4 using a digital copy machine Konica 7060 converted model supplied from Konica Corporation. In the table, claim construction conditions (film thickness of photoconductors, weight average particle sizes (D4) of carriers, the above (S)) and the like in respective combinations were described in addition.

TABLE 4

| | Photoconductor No. (total thickness of photosensitive layer and protective layer(μm)) | Developer No. | Toner No. | Percentage of toner particle with shape coefficient of 1.2 to 1.6 (%) | M ($m_1 + m_2$) | Carrier No. | Average particle size of carrier (μm) | Specific gravity of carrier | Average mass of one carrier particle (g) | Line speed of development sleeve (mm/sec) | Line speed of photoconductor (mm/sec) | Average fretting energy (S: $kgm^2/sec^2$) |
|---|---|---|---|---|---|---|---|---|---|---|---|---|
| Example 1 | 1(12.5) | 1 | 1 | 66.3 | 80.7 | 1 | 35 | 3.53 | 7.9E-08 | 740 | 370 | 1.08E-08 |
| Example 2 | 1(12.5) | 2 | 1 | 66.3 | 80.7 | 2 | 20 | 3.53 | 1.5E-08 | 740 | 370 | 2.02E-09 |
| Example 3 | 1(12.5) | 3 | 1 | 66.3 | 80.7 | 3 | 48 | 3.53 | 2E-07 | 740 | 370 | 2.79E-08 |
| Comparative Example 1 | 1(12.5) | 4 | 1 | 66.3 | 80.7 | 4 | 55 | 3.53 | 3.1E-07 | 740 | 370 | 4.20E-08 |
| Comparative Example 2 | 1(12.5) | 5 | 1 | 66.3 | 80.7 | 5 | 10 | 3.53 | 1.8E-09 | 740 | 370 | 2.52E-10 |
| Example 4 | 1(12.5) | 6 | 2 | 73.2 | 82.3 | 1 | 35 | 3.53 | 7.9E-08 | 740 | 370 | 1.08E-08 |
| Example 5 | 1(12.5) | 7 | 3 | 65.1 | 71.4 | 1 | 35 | 3.53 | 7.9E-08 | 740 | 370 | 1.08E-08 |
| Example 6 | 1(12.5) | 8 | 4 | 63.4 | 70.5 | 1 | 35 | 3.53 | 7.9E-08 | 740 | 370 | 1.08E-08 |
| Example 7 | 1(12.5) | 9 | 5 | 65.1 | 67.4 | 1 | 35 | 3.53 | 7.9E-08 | 740 | 370 | 1.08E-08 |
| Example 8 | 1(12.5) | 10 | 6 | 60.5 | 68.3 | 1 | 35 | 3.53 | 7.9E-08 | 740 | 370 | 1.08E-08 |
| Example 9 | 2(15.0) | 1 | 1 | 66.3 | 80.7 | 1 | 35 | 3.53 | 7.9E-08 | 740 | 370 | 1.08E-08 |
| Example 10 | 3(6.5) | 1 | 1 | 66.3 | 80.7 | 1 | 35 | 3.53 | 7.9E-08 | 740 | 370 | 1.08E-08 |
| Comparative Example 3 | 4(16.0) | 1 | 1 | 66.3 | 80.7 | 1 | 35 | 3.53 | 7.9E-08 | 740 | 370 | 1.08E-08 |
| Comparative Example 4 | 5(4.0) | 1 | 1 | 66.3 | 80.7 | 1 | 35 | 3.53 | 7.9E-08 | 740 | 370 | 1.08E-08 |
| Example 11 | 6(13.8) | 1 | 1 | 66.3 | 80.7 | 1 | 35 | 3.53 | 7.9E-08 | 740 | 370 | 1.08E-08 |
| Example 12 | 7(11.0) | 1 | 1 | 66.3 | 80.7 | 1 | 35 | 3.53 | 7.9E-08 | 740 | 370 | 1.08E-08 |
| Example 13 | 8(14.0) | 1 | 1 | 66.3 | 80.7 | 1 | 35 | 3.53 | 7.9E-08 | 740 | 370 | 1.08E-08 |
| Example 14 | 9(8.0) | 1 | 1 | 66.3 | 80.7 | 1 | 35 | 3.53 | 7.9E-08 | 740 | 370 | 1.08E-08 |
| Example 15 | 10(10.5) | 1 | 1 | 66.3 | 80.7 | 1 | 35 | 3.53 | 7.9E-08 | 740 | 370 | 1.08E-08 |

c. 1. Evaluation Condition

Evaluation conditions of the Konica 7060 converted model are shown below.

Line speed of photoconductor: 370 (mm/sec)

Charging Condition

Charging tool: Scorotron charging tool, initial charging aim: −500 V to −600 V

Light Exposure Condition

Exposure site potential aim: set a light exposure amount to make−50 V

Exposure beam: Image exposure at a dot density of 400 dpi (dpi is the dot number per 2.54 cm) was performed. Laser beam spot area: $0.8\times10^{-9}$ $m^2$, a semiconductor laser with 680 nm was used as the laser.

Development Condition (Reverse Development Condition)

Development bias: DC bias=−400 V to −500 V

Dsd (distance between photoconductor and development sleeve): 600 μm

Layer thickness of developer: 700 μm

Development sleeve diameter: 40 mm

Line speed of development sleeve: 740 (mm/sec)

Transfer Condition

Transfer pole: corona charging mode

Separation condition: a separation means of a separation claw unit was used.

Cleaning Condition

Cleaning Blade:

An elastic rubber blades with rubber hardness of JISA70°, rebound resilience of 55, thickness of 2 mm and free length of 9 mm made of polyurethane was abutted in a counter direction against the rotation of photoconductor at an abutting angle of 20° by a weighted load mode with pressure of 20 g/cm.

c. 2. Evaluation Item 1

Image Unevenness

Image unevenness: Using the above Konica 7060 converted model, 100,000 sheets of copies were continuously performed under high temperature and humidity (HH: 30°

C., 80RH %) condition. After the completion of copying, an original image of a half tone image with density of 0.4 was copied to a copied image with density of 0.4. The evaluation was determined by density difference of the copied images (ΔHD=maximum density−minimum density).

A: ΔHD is 0.05 or less (good)

B: ΔHD is more than 0.05 and less than 0.1 (no practical problem)

D: ΔHD is 0.1 or more (practically problematic)

Evaluation of Toner Scatterings in Text

As with the above, after continuously copying 100,000 sheets, an original image having a lattice image with a width of 5 cm made of 0.1 mm lines at a head portion was copied to evaluate. The evaluation was performed by magnifying a copied image to 20 times and observing continuity of lines and occurrence of toner scatterings.

A: No toner scattering and thin lines are continuous.

B: Toner scatterings occur at a visually undetectable level and thin lines are continuous.

C: Toner scatterings occur at a visually detectable level but thin lines are continuous.

D: Toner scatterings occur at a visually detectable level and thin lines are not continuous.

c. 3. Evaluation Item 2

Sharpness

As with the above, after continuously copying 100,000 sheets, the evaluation was performed by smeared texts. A text image with 3 point and 5 point was formed, and evaluated by the following determination criteria.

A: Both 3 point and 5 point texts are clear and easily readable.

B: A part of 3 point texts is unreadable, but the 5 point texts are clear and easily readable.

D: The 3 point texts are nearly unreadable and a part or all of the 5 point texts are unreadable.

Carrier Adhesion

As with the above, after continuously copying 100,000 sheets, an image and a photoconductor surface were observed and the evaluation was performed by the following determination criteria.

A: Carrier adhesion is scarcely observed on the photoconductor surface, and no image defect due to the carrier adhesion is observed.

B: The carrier adhesion is observed on the photoconductor surface, and no image defect due to the carrier adhesion is observed.

D: The carrier adhesion is observed on the photoconductor surface, and the image defect due to the carrier adhesion (spotty image defect) occurs c. 4. Evaluation Results Evaluation results are shown in Table 5.

TABLE 5

| | Image unevenness | Toner scatterings in text | Sharpness | Carrier adhesion |
|---|---|---|---|---|
| Example 1 | A | A | A | A |
| Example 2 | A | C | B | A |
| Example 3 | B | B | B | A |
| Comparative example 1 | D | D | D | A |
| Comparative example 2 | B | C | B | D |
| Example 4 | A | A | A | A |

TABLE 5-continued

| | Image unevenness | Toner scatterings in text | Sharpness | Carrier adhesion |
|---|---|---|---|---|
| Example 5 | A | A | A | A |
| Example 6 | A | B | B | A |
| Example 7 | A | C | B | A |
| Example 8 | B | C | B | A |
| Example 9 | B | B | B | A |
| Example 10 | B | B | B | A |
| Comparative example 3 | B | B | D | A |
| Comparative example 4 | D | D | D | A |
| Example 11 | A | A | A | A |
| Example 12 | A | A | A | A |
| Example 13 | A | A | A | A |
| Example 14 | A | A | A | A |
| Example 15 | A | A | A | A |

As is obvious from Table 5, Examples 1 to 15, which are the combinations which fulfill the conditions of the photoconductor of the invention, i.e., the conditions of the organic photoconductor where the total film thickness of the photosensitive layer (charge generation layer and charge transport layer) and the protection layer is from 5 to 15 μm and the two-component developer where the carrier weight average particle size (D4) is from 20 to 50 μm, obtain the improved evaluation results in respective evaluation items of the image unevenness, toner scatterings in text and sharpness, relative to Comparative examples 1 to 4 which are the combinations which do not fulfill at least one of the above conditions. In particular, Examples 1 to 3, 5, 11 to 15 using the organic photoconductor, where the total film thickness of the photosensitive layer and the protection layer is from 8 to 14 μm and the toner which fulfills the condition that the toner particles with shape coefficient within 1.2 to 1.6 in the developer are 65% or more by number and the sum (M) of the relative frequency ($m_1$) of the toner particles included in the most frequent class and the relative frequency ($m_2$) of the toner particles included in the second frequent class is 70% or more, have noticeable improvement effects in respective evaluation items. On the other hand, Comparative example 3 using the photoconductor 4 where the total film thickness of the photosensitive layer and the protection layer is 16 μm is inferior in sharpness, and in Comparative example 4 using the photoconductor 5 where the total film thickness of the photosensitive layer and the protection layer is 4 μm, the charging potential is insufficient, the image unevenness and the toner scatterings in text occur, and the sharpness is deteriorated.

Also, in Comparative example 1 using the developer 4 where the carrier weight average particle size (D4) is 55 μm, the image unevenness and the toner scatterings in text occur, and the sharpness is deteriorated, and in Comparative example 2 using the developer 5 where the carrier weight average particle size (D4) is 10 μm, the carrier adhesion occurs.

d. Evaluation 2

The evaluation was performed as is the case with the evaluation 1 by changing the line speed of the development sleeve as shown in Table 6 in the conditions of the combination 1 in the above evaluation 1 to change (S). The results are shown in Table 7.

TABLE 6

| | Photoconductor No. (total thickness of photosensitive layer and protective layer(μm)) | Developer No. | Toner No. | Percentage of toner particle with shape coefficient of 1.2 to 1.6 (%) | M ($m_1 + m_2$) | Carrier No. | Average particle size of carrier (μm) | Specific gravity of carrier | Average mass of one carrier particle (g) | Line speed of development sleeve (mm/sec) | Line speed of photoconductor (mm/sec) | Average fretting energy (S: $kgm^2/sec^2$) |
|---|---|---|---|---|---|---|---|---|---|---|---|---|
| Example 16 | 1(12.5) | 1 | 1 | 66.3 | 80.7 | 1 | 35 | 3.53 | 7.92E-08 | 740 | 900 | 2.03E-09 |
| Example 17 | 1(12.5) | 1 | 1 | 66.3 | 80.7 | 1 | 35 | 3.53 | 7.92E-08 | 740 | 600 | 1.55E-09 |
| Example 18 | 1(12.5) | 1 | 1 | 66.3 | 80.7 | 1 | 35 | 3.53 | 7.92E-08 | 740 | 400 | 9.16E-09 |
| Example 19 | 1(12.5) | 1 | 1 | 66.3 | 80.7 | 1 | 35 | 3.53 | 7.92E-08 | 740 | 200 | 2.31E-08 |

TABLE 7

| | Image unevenness | Toner scatterings in text | Sharpness | Carrier adhesion |
|---|---|---|---|---|
| Example 16 | B | C | B | B |
| Example 17 | A | A | A | A |
| Example 18 | B | B | B | A |
| Example 19 | B | A | B | A |

As shown in Table 7, even when the value of S is within the invention, Examples 16 to 19 where the line speed of the development sleeve is higher than that of the photoconductor obtain better evaluation results.

In the above embodiment of the invention, the occurrence of image unevenness and toner scatterings in text due to the attrition unevenness, which easily occurred in the organic photoconductor having a photosensitive layer of a thin layer was prevented, and the electrophotographic image having high resolution was obtained. Also, it was possible to provide an image forming apparatus with good image performance using the image forming method.

The entire disclosure of Japanese Patent Application No. Tokugan 2003-325881 filed on Sep. 18, 2003 including specification, claims, drawings and summary are incorporated herein by reference in its entirety.

What is claimed is:

1. An image forming method comprising:

forming an electrostatic latent image by exposing a organic photoconductor to exposure light after charging the organic photoconductor; and developing the electrostatic latent image into a toner image by bringing a developer containing toner and a carrier having a weight average particle size (D4) of 20 to 50 μm into contact with the organic photoconductor comprising a photosensitive layer and a protective layer which is provided when needed, a total thickness of the photosensitive layer and the protective layer being 5 to 15 μm.

2. The image forming method of claim 1, wherein the toner contains not less than 65% by number of toner particles having a shape coefficient in a range of 1.2 to 1.6.

3. The image forming method of claim 1, wherein when particle size of the toner particle is denoted by D (μm), in a histogram whose abscissa is a natural logarithm lnD and which represents a particle size distribution by number classified into a plurality of classes at intervals of 0.23 on the abscissa, a sum (M) of a relative frequency of toner particles included in a most frequent class in the histogram and a relative frequency of toner particles included in a second most frequent class is not less than 70%.

4. The image forming method of claim 1, wherein the carrier is a resin dispersion type carrier in which magnetic particles are dispersed in a binder resin.

5. The image forming method of claim 1, wherein S defined below is $1.5\times10^{-9}$ to $3.0\times10^{-8}$ $kgm^2/sec^2$ in the developing of the electrostatic latent image:

S ($kgm^2/sec^2$)=average mass of one carrier particle×(line speed of development sleeve−line speed of organic photoconductor)$^2$.

6. The image forming method of claim 1, wherein the toner contains an inorganic external additive having a particle size of 0.01 to 1.0 μm.

7. An image forming apparatus comprising:

a rotatable drum where a layer of an organic photoconductor in which a total thickness of a photosensitive layer and a protective layer which is provided when needed is 5 to 15 μm, is formed on a peripheral surface;

a charging unit for charging the organic photoconductor;

a semiconductor laser light source for exposing the organic photoconductor to an exposure light to form an electrostatic latent image;

a development tool for bringing a developer containing toner and a carrier having a weight average particle size (D4) of 20 to 50 μm into contact with the electrostatic latent image to develop the latent image; and a transfer tool for transferring the toner developed on the layer of the organic photoconductor to an image support.

* * * * *